US012090372B2

(12) United States Patent
Greensmith et al.

(10) Patent No.: US 12,090,372 B2
(45) Date of Patent: Sep. 17, 2024

(54) GOLF CLUB HEAD

(71) Applicant: Taylor Made Golf Company, Inc., Carlsbad, CA (US)

(72) Inventors: Matthew Greensmith, Vista, CA (US); Todd P. Beach, Encinitas, CA (US); Nathan T. Sargent, Oceanside, CA (US); Kraig Alan Willett, Fallbrook, CA (US); Joshua J. Dipert, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 643 days.

(21) Appl. No.: 17/171,678

(22) Filed: Feb. 9, 2021

(65) Prior Publication Data

US 2021/0162273 A1 Jun. 3, 2021

Related U.S. Application Data

(63) Continuation of application No. 17/107,652, filed on Nov. 30, 2020, now Pat. No. 11,266,885, which is a (Continued)

(51) Int. Cl.
*A63B 53/04* (2015.01)
*A63B 53/02* (2015.01)
(Continued)

(52) U.S. Cl.
CPC ..... *A63B 53/02* (2013.01); *A63B 53/04* (2013.01); *A63B 53/0466* (2013.01);
(Continued)

(58) Field of Classification Search
CPC .. A63B 53/04; A63B 53/0408; A63B 53/0437
See application file for complete search history.

(56) References Cited

U.S. PATENT DOCUMENTS 838,284 A 12/1906 Mitchell et al.
1,133,129 A 3/1915 Govan
(Continued)

FOREIGN PATENT DOCUMENTS

JP 1043278 2/1989
JP 64043278 2/1989
(Continued)

OTHER PUBLICATIONS

Office Action from the Japanese Patent Office (English translation) for related Japanese Patent Application No. 2013-133366, 8 pages, dated Aug. 20, 2014.

*Primary Examiner* — Joshua T Kennedy
(74) *Attorney, Agent, or Firm* — Klarquist Sparkman, LLP

(57) ABSTRACT

A golf club head includes a body defining an interior cavity. The body includes a sole positioned at a bottom portion of the golf club head, a crown positioned at a top portion, and a skirt positioned around a periphery between the sole and crown. The body has a forward portion and a rearward portion. The club head includes a face positioned at the forward portion of the body. In some embodiments, the crown includes a lattice-like structure having thin regions surrounded by a web of relatively thicker regions. In some embodiments, the club head includes one or more stiffening tubes attached between the sole and the crown to improve the acoustic performance of the golf club head.

28 Claims, 17 Drawing Sheets

Related U.S. Application Data continuation of application No. 16/584,589, filed on Sep. 26, 2019, now Pat. No. 10,888,742, which is a continuation of application No. 16/123,504, filed on Sep. 6, 2018, now Pat. No. 10,463,925, which is a continuation of application No. 15/711,818, filed on Sep. 21, 2017, now Pat. No. 10,092,797, which is a continuation of application No. 15/609,933, filed on May 31, 2017, now Pat. No. 9,795,840, which is a continuation of application No. 15/190,588, filed on Jun. 23, 2016, now Pat. No. 9,795,839, which is a continuation of application No. 15/159,291, filed on May 19, 2016, now Pat. No. 9,623,291, which is a continuation of application No. 14/734,181, filed on Jun. 9, 2015, now Pat. No. 9,399,157, which is a continuation of application No. 13/730,039, filed on Dec. 28, 2012, now Pat. No. 9,079,078.

(60) Provisional application No. 61/581,516, filed on Dec. 29, 2011.

(51) Int. Cl.
*A63B 60/00* (2015.01)
*A63B 60/52* (2015.01)

(52) U.S. Cl.
CPC ..... *A63B 60/00* (2015.10); *A63B 60/52* (2015.10); *A63B 53/022* (2020.08); *A63B 53/023* (2020.08); *A63B 53/025* (2020.08); *A63B 53/026* (2020.08); *A63B 53/027* (2020.08); *A63B 53/0408* (2020.08); *A63B 53/0412* (2020.08); *A63B 53/0433* (2020.08); *A63B 53/0437* (2020.08); *A63B 53/045* (2020.08); *A63B 53/0454* (2020.08); *A63B 53/0458* (2020.08); *A63B 2053/0491* (2013.01); *A63B 60/002* (2020.08)

(56) References Cited

U.S. PATENT DOCUMENTS 1,349,806 A 8/1920 Booth
1,658,581 A 2/1928 Tobia
2,155,830 A 9/1938 Howard
3,437,133 A 4/1969 Bullard
3,608,173 A 9/1971 Watson et al.
3,652,094 A 3/1972 Glover
4,139,196 A 2/1979 Riley
4,214,754 A 7/1980 Zebelean
4,334,703 A 6/1982 Arthur et al.
4,461,479 A 7/1984 Mitchell
4,602,787 A 7/1986 Sugioka et al.
4,606,491 A 8/1986 Le Mong
4,754,974 A 7/1988 Kobayashi
4,775,156 A 10/1988 Thompson
4,795,159 A 1/1989 Nagamoto
4,811,949 A 5/1989 Kobayashi
4,877,249 A 10/1989 Thompson
4,883,274 A 11/1989 Hsien
4,895,371 A 1/1990 Bushner
4,930,781 A 6/1990 Allen
5,004,241 A 4/1991 Antonious
5,067,715 A 11/1991 Schmidt et al.
5,082,278 A 1/1992 Hsien
5,152,527 A 10/1992 Mather et al.
5,180,166 A 1/1993 Schmidt et al.
5,207,428 A 5/1993 Aizawa
5,232,224 A 8/1993 Zeider
5,273,283 A 12/1993 Bowland
5,299,807 A 4/1994 Hutin
5,316,305 A 5/1994 McCabe
5,346,217 A 9/1994 Tsuchiya et al.
5,346,218 A 9/1994 Wyte
5,419,559 A 5/1995 Melanson et al.
5,429,365 A 7/1995 McKeighen
5,464,216 A 11/1995 Hoshi et al.
5,489,097 A 2/1996 Simmons
5,497,993 A 3/1996 Shan
5,518,240 A 5/1996 Igarashi
5,533,728 A 7/1996 Pehoski et al.
5,582,553 A 12/1996 Ashcraft et al.
5,586,947 A 12/1996 Hutin
5,624,331 A 4/1997 Lo et al.
5,692,967 A 12/1997 Guyer
5,700,208 A 12/1997 Nelms
5,709,617 A 1/1998 Nishimura et al.
5,755,627 A 5/1998 Yamazaki et al.
5,766,094 A 6/1998 Mahaffey et al.
5,769,737 A 6/1998 Holladay et al.
5,772,529 A 6/1998 Ruth, Jr.
5,908,356 A 6/1999 Nagamoto
5,921,872 A 7/1999 Kobayashi
5,935,020 A 8/1999 Stites et al.
5,954,596 A 9/1999 Noble et al.
6,015,354 A 1/2000 Ahn et al.
6,027,416 A 2/2000 Schmidt et al.
6,033,318 A 3/2000 Drajan, Jr. et al.
6,059,669 A 5/2000 Pearce
6,062,988 A 5/2000 Yamamoto
6,149,533 A 11/2000 Finn
6,277,032 B1 8/2001 Smith
6,299,547 B1 10/2001 Kosmatka
6,332,847 B2 12/2001 Murphy et al.
6,354,963 B1 * 3/2002 Kodama ..... A63B 53/04 473/345
6,368,230 B1 4/2002 Helmstetter et al.
6,368,231 B1 4/2002 Chen
6,379,264 B1 4/2002 Forzano
6,383,090 B1 5/2002 O'Doherty et al.
6,413,168 B1 7/2002 McKendry et al.
6,435,978 B1 8/2002 Galloway et al.
6,475,100 B1 11/2002 Helmstetter et al.
6,506,128 B1 1/2003 Bloom, Jr.
6,524,197 B2 2/2003 Boone
6,663,503 B1 12/2003 Kenmi
6,669,577 B1 12/2003 Hocknell et al.
6,739,983 B2 5/2004 Helmstetter et al.
6,749,523 B1 6/2004 Forzano
6,769,996 B2 8/2004 Tseng
6,776,723 B2 8/2004 Bliss et al.
6,776,725 B1 * 8/2004 Miura ..... A63B 53/0466 473/345
6,783,465 B2 8/2004 Matsunaga
RE38,605 E 9/2004 Kubica et al.
6,835,145 B2 12/2004 Tsurumaki
6,852,038 B2 2/2005 Yabu
6,923,734 B2 8/2005 Meyer
6,974,393 B2 12/2005 Caldwell et al.
6,979,270 B1 12/2005 Allen
7,008,332 B2 3/2006 Liou
7,056,228 B2 * 6/2006 Beach ..... A63B 53/0466 473/345
7,066,835 B2 6/2006 Evans et al.
7,074,136 B2 7/2006 Noguchi
7,083,529 B2 8/2006 Cackett et al.
7,108,609 B2 9/2006 Stites et al.
7,108,614 B2 9/2006 Lo
7,128,661 B2 10/2006 Soracco et al.
7,137,905 B2 11/2006 Kohno
7,147,573 B2 12/2006 DiMarco
7,166,041 B2 1/2007 Evans
7,175,541 B2 2/2007 Lo
7,241,229 B2 7/2007 Poyno
7,247,103 B2 7/2007 Beach et al.
7,250,007 B2 7/2007 Lu
7,258,624 B2 8/2007 Kobayashi
7,273,423 B2 9/2007 Imamoto
D553,206 S 10/2007 Morales et al.
7,281,992 B2 10/2007 Tseng
7,300,359 B2 11/2007 Hocknell et al.
D557,362 S 12/2007 Serrano et al.

(56) References Cited

U.S. PATENT DOCUMENTS 7,303,487 B2 12/2007 Kumanmoto
7,326,126 B2 2/2008 Holt
7,335,113 B2 2/2008 Hocknell et al.
7,351,161 B2 4/2008 Beach
7,387,579 B2 6/2008 Lin et al.
7,445,563 B1 11/2008 Werner
7,448,964 B2 11/2008 Schweigert et al.
7,494,424 B2 2/2009 Williams et al.
7,510,485 B2 3/2009 Yamamoto
7,520,820 B2 4/2009 DeMarco et al.
7,563,177 B2 7/2009 Jertson et al.
7,563,178 B2 7/2009 Rae et al.
7,591,736 B2 9/2009 Ban
7,597,634 B2 10/2009 Werner et al.
7,611,424 B2 11/2009 Nagai et al.
7,632,196 B2 12/2009 Reed et al.
7,641,568 B2 1/2010 Hoffman et al.
7,686,708 B2 3/2010 Morales et al.
7,691,006 B1 4/2010 Burke
7,699,719 B2 4/2010 Sugimoto
7,744,484 B1 6/2010 Chao
7,749,103 B2 7/2010 Nakano
7,771,291 B1 8/2010 Willett
7,775,905 B2 8/2010 Beach et al.
7,798,203 B2 9/2010 Schweigert et al.
7,824,277 B2 11/2010 Bennett et al.
7,892,111 B2 2/2011 Morales et al.
7,914,393 B2 3/2011 Hirsch et al.
7,927,231 B2 4/2011 Sato et al.
7,959,523 B2 6/2011 Rae et al.
7,967,700 B2 6/2011 Stites
8,016,694 B2 9/2011 Llewellyn et al.
8,025,587 B2 9/2011 Beach et al.
8,147,354 B2 4/2012 Hartwell et al.
8,187,119 B2 5/2012 Rae et al.
8,192,303 B2 6/2012 Ban
8,197,357 B1 6/2012 Rice et al.
8,202,175 B2 6/2012 Ban
8,206,244 B2 6/2012 Honea et al.
8,216,087 B2 7/2012 Breier et al.
8,298,096 B2 10/2012 Stites et al.
8,337,319 B2 12/2012 Sargent et al.
8,357,056 B2 1/2013 Horacek et al.
8,357,058 B2 1/2013 Honea et al.
8,403,771 B1 3/2013 Rice et al.
8,491,415 B2 7/2013 Demille et al.
8,491,416 B1 7/2013 Demille et al.
8,523,702 B2 9/2013 Thomas et al.
8,523,705 B2 9/2013 Breier et al.
8,540,587 B2 9/2013 Hirsch et al.
8,591,352 B2 11/2013 Hirano
8,591,353 B1 11/2013 Honea et al.
8,608,585 B2 12/2013 Stites et al.
8,608,591 B2 12/2013 Chao et al.
8,641,547 B2 2/2014 Rauchholz et al.
8,647,216 B2 2/2014 Seluga et al.
8,696,491 B1 4/2014 Myers
8,747,251 B2 6/2014 Hayase et al.
8,758,164 B2 6/2014 Breier
8,771,097 B2 7/2014 Bennett et al.
8,834,293 B2 9/2014 Thomas et al.
8,870,679 B2 10/2014 Oldknow
8,979,671 B1 3/2015 Demille et al.
9,067,110 B1 6/2015 Seluga et al.
9,079,078 B2 7/2015 Greensmith
9,101,811 B1 8/2015 Goudarzi et al.
9,180,349 B1 11/2015 Seluga et al.
9,216,332 B1 12/2015 Ehlers et al.
9,259,625 B2 2/2016 Sargent et al.
9,289,660 B1 3/2016 Myers
9,399,157 B2 7/2016 Greensmith
9,486,677 B1 11/2016 Seluga
9,623,291 B2 4/2017 Greensmith et al.
9,795,840 B2 10/2017 Greensmith
9,943,733 B2 4/2018 Franklin et al.
10,463,925 B2 11/2019 Greensmith
10,888,742 B2 1/2021 Greensmith et al.
11,865,415 B2 1/2024 Oldknow et al.
2002/0137576 A1 9/2002 Dammen
2003/0104878 A1 6/2003 Yabu
2003/0134688 A1 7/2003 Rice
2003/0153401 A1* 8/2003 Helmstetter ..... A63B 53/02 473/342
2004/0116207 A1 6/2004 De Shiell et al.
2004/0192468 A1 9/2004 Onoda et al.
2005/0037861 A1* 2/2005 Kobayashi ..... A63B 53/0466 473/345
2005/0143189 A1 6/2005 Lai et al.
2005/0221913 A1 10/2005 Kusumoto
2005/0261082 A1 11/2005 Yamamoto
2006/0019769 A1* 1/2006 Lo ..... A63B 60/52 473/345
2006/0052181 A1* 3/2006 Serrano ..... A63B 53/0466 473/345
2006/0122004 A1 6/2006 Chen et al.
2006/0178228 A1 8/2006 DiMarco
2006/0217216 A1 9/2006 Iizuka
2006/0223651 A1 10/2006 Borunda
2006/0240908 A1 10/2006 Adams et al.
2006/0293118 A1 12/2006 Meyer et al.
2007/0032313 A1 2/2007 Serrano et al.
2007/0135231 A1 6/2007 Lo
2007/0155529 A1 7/2007 Voges
2007/0155533 A1 7/2007 Solheim et al.
2007/0178988 A1 8/2007 Tavares et al.
2007/0232408 A1 10/2007 Horacek
2007/0265108 A1 11/2007 Lin et al.
2008/0020861 A1 1/2008 Adams et al.
2008/0045356 A1* 2/2008 Lin ..... A63B 53/0466 473/346
2008/0070721 A1 3/2008 Chen et al.
2008/0076590 A1 3/2008 Hsu
2008/0132355 A1 6/2008 Hoffman
2008/0194354 A1 8/2008 Nagai et al.
2008/0254908 A1 10/2008 Bennett et al.
2008/0261715 A1 10/2008 Carter
2008/0280693 A1 11/2008 Chai
2009/0011849 A1 1/2009 Thomas et al.
2009/0031551 A1* 2/2009 Schweigert ..... A63B 60/52 29/527.5
2009/0124407 A1 5/2009 Hocknell et al.
2009/0143167 A1 6/2009 Evans
2009/0203462 A1 8/2009 Stites et al.
2009/0286611 A1 11/2009 Beach
2009/0298613 A1 12/2009 Hirsch
2010/0041491 A1 2/2010 Thomas et al.
2010/0069170 A1 3/2010 Bennett et al.
2010/0075773 A1 3/2010 Casati, Jr.
2010/0075774 A1 3/2010 Ban
2010/0093462 A1 4/2010 Stites et al.
2010/0144461 A1 6/2010 Ban
2010/0167837 A1 7/2010 Ban
2010/0197424 A1 8/2010 Beach et al.
2010/0234122 A1 9/2010 Sander et al.
2010/0255931 A1* 10/2010 Ni ..... A63B 53/0466 473/349
2010/0273565 A1 10/2010 Stites et al.
2010/0292018 A1 11/2010 Cackett et al.
2010/0292027 A1 11/2010 Beach et al.
2010/0304887 A1 12/2010 Bennett et al.
2010/0317454 A1 12/2010 Sato et al.
2010/0323808 A1 12/2010 Sato et al.
2010/0331101 A1 12/2010 Sato et al.
2011/0009206 A1 1/2011 Soracco
2011/0009209 A1 1/2011 Llewellyn et al.
2011/0009210 A1 1/2011 Stites et al.
2011/0039631 A1 2/2011 Oldknow et al.
2011/0039634 A1 2/2011 Tavares et al.
2011/0152000 A1 6/2011 Sargent
2011/0172027 A1 7/2011 Hirsch et al.
2011/0224017 A1 9/2011 Thomas et al.
2011/0306441 A1* 12/2011 Tsukada ..... A63B 53/0466 473/345

(56) References Cited

U.S. PATENT DOCUMENTS

| | | | | |
|---|---|---|---|---|
| 2012/0071258 | A1 | 3/2012 | Yamaguchi et al. | |
| 2012/0071261 | A1 | 3/2012 | Yamamoto | |
| 2012/0094780 | A1 | 4/2012 | Slaughter et al. | |
| 2012/0122601 | A1 | 5/2012 | Beach et al. | |
| 2012/0165115 | A1 | 6/2012 | Matsunaga | |
| 2012/0178550 | A1* | 7/2012 | Solheim | A63B 60/52 473/345 |
| 2012/0196701 | A1 | 8/2012 | Stites et al. | |
| 2012/0202615 | A1 | 8/2012 | Beach et al. | |
| 2012/0220387 | A1 | 8/2012 | Beach et al. | |
| 2012/0302367 | A1 | 11/2012 | Myrhum et al. | |
| 2012/0322573 | A1* | 12/2012 | Boyd | A63B 60/00 473/282 |
| 2013/0102410 | A1 | 4/2013 | Stites et al. | |
| 2013/0130829 | A1 | 5/2013 | Bennett et al. | |
| 2013/0130834 | A1 | 5/2013 | Stites et al. | |
| 2013/0165252 | A1 | 6/2013 | Rice et al. | |
| 2013/0184099 | A1 | 7/2013 | Stites et al. | |
| 2013/0244808 | A1 | 9/2013 | Bennett et al. | |
| 2013/0324290 | A1 | 12/2013 | Oldknow et al. | |
| 2014/0051529 | A1 | 2/2014 | Honea et al. | |
| 2014/0057739 | A1 | 2/2014 | Stites et al. | |
| 2014/0080629 | A1 | 4/2014 | Sargent | |
| 2014/0113742 | A1 | 4/2014 | Zimmerman et al. | |
| 2014/0155193 | A1* | 6/2014 | Takechi | A63B 53/0466 473/345 |
| 2014/0187346 | A1 | 7/2014 | Beno | |
| 2014/0329616 | A1* | 11/2014 | Stokke | A63B 53/0466 473/346 |
| 2015/0031468 | A1 | 1/2015 | Matsunaga et al. | |
| 2015/0038261 | A1 | 2/2015 | Stites et al. | |
| 2015/0094166 | A1 | 4/2015 | Taylor et al. | |
| 2015/0290503 | A1* | 10/2015 | Su | A63B 53/0466 473/324 |
| 2015/0298196 | A1* | 10/2015 | Su | B21K 17/00 72/352 |
| 2015/0306473 | A1 | 10/2015 | Breier et al. | |
| 2016/0001146 | A1 | 1/2016 | Sargent et al. | |
| 2016/0101331 | A1 | 4/2016 | Luttrell et al. | |
| 2016/0136490 | A1 | 5/2016 | Sargent et al. | |
| 2016/0250527 | A1 | 9/2016 | Seluga et al. | |
| 2019/0134470 | A1 | 5/2019 | Greensmith et al. | |
| 2019/0192930 | A1* | 6/2019 | Cleghorn | A63B 60/42 |
| 2019/0269984 | A1 | 9/2019 | Mata et al. | |

FOREIGN PATENT DOCUMENTS

| | | | |
|---|---|---|---|
| JP | 3725251 | | 2/1998 |
| JP | 10201886 | | 8/1998 |
| JP | 4001970 | | 10/1998 |
| JP | H11155982 | A | 6/1999 |
| JP | 4009359 | | 10/1999 |
| JP | 3211755 | | 9/2001 |
| JP | 2001238988 | | 9/2001 |
| JP | 2002113134 | | 4/2002 |
| JP | 2002126136 | | 5/2002 |
| JP | 3854066 | | 7/2002 |
| JP | 2003088601 | | 3/2003 |
| JP | 4098583 | | 5/2003 |
| JP | 2004159794 | | 6/2004 |
| JP | 2005111172 | | 4/2005 |
| JP | 3109209 | U | 5/2005 |
| JP | 2005137788 | | 6/2005 |
| JP | 4411972 | | 7/2005 |
| JP | 3113023 | U | 9/2005 |
| JP | 2005287529 | | 10/2005 |
| JP | 2005312942 | | 11/2005 |
| JP | 2006116002 | | 5/2006 |
| JP | 3124540 | U | 8/2006 |
| JP | 3124726 | U | 8/2006 |
| JP | 3821516 | | 9/2006 |
| JP | 4358766 | | 9/2006 |
| JP | 2006263071 | | 10/2006 |
| JP | 2006-320493 | | 11/2006 |
| JP | 3126818 | U | 11/2006 |
| JP | 4455442 | | 2/2007 |
| JP | 2007244715 | | 9/2007 |
| JP | 2007267777 | | 10/2007 |
| JP | 2007275547 | | 10/2007 |
| JP | 4057286 | B | 3/2008 |
| JP | 2008086351 | | 4/2008 |
| JP | 2008148762 | | 7/2008 |
| JP | 2008295586 | | 12/2008 |
| JP | 2009153802 | | 7/2009 |
| JP | 4319420 | B | 8/2009 |
| JP | 4322104 | B | 8/2009 |
| JP | 2009172116 | | 8/2009 |
| JP | 2009233266 | | 10/2009 |
| JP | 4373765 | B | 11/2009 |
| JP | 2010029358 | | 2/2010 |
| JP | 2010-136772 | | 6/2010 |
| JP | 4566936 | B2 | 10/2010 |
| JP | 2011-10722 | | 1/2011 |
| JP | 4639749 | | 2/2011 |
| JP | 2006167163 | | 6/2016 |
| JP | 2006192110 | | 7/2016 |
| JP | 2007044279 | | 2/2017 |
| JP | 4466867 | | 4/2017 |

* cited by examiner

GOLF CLUB HEAD

CROSS-REFERENCE TO RELATED APPLICATIONS

This application is a continuation of U.S. patent application Ser. No. 17/107,652, filed Nov. 30, 2020, which is a continuation of U.S. patent application Ser. No. 16/584,589, filed Sep. 26, 2019, now U.S. Pat. No. 10,888,742, issued Jan. 12, 2021, which is a continuation of U.S. patent application Ser. No. 16/123,504, filed Sep. 6, 2018, now U.S. Pat. No. 10,463,925, issued Nov. 5, 2019, which is a continuation of U.S. patent application Ser. No. 15/711,818, filed Sep. 21, 2017, now U.S. Pat. No. 10,092,797, issued Oct. 9, 2018, which is a continuation of U.S. patent application Ser. No. 15/609,933, filed May 31, 2017, now U.S. Pat. No. 9,795,840, issued Oct. 24, 2017, which is a continuation of U.S. patent application Ser. No. 15/190,588, filed Jun. 23, 2016, now U.S. Pat. No. 9,795,839, issued Oct. 24, 2017, which is a continuation of U.S. patent application Ser. No. 15/159,291, filed May 19, 2016, now U.S. Pat. No. 9,623,291, issued Apr. 18, 2017, which is a continuation of U.S. patent application Ser. No. 14/734,181, filed Jun. 9, 2015, now U.S. Pat. No. 9,399,157, issued Jul. 26, 2016, which is a continuation of U.S. patent application Ser. No. 13/730,039, filed Dec. 28, 2012, now U.S. Pat. No. 9,079,078, issued Jul. 14, 2015, which claims the benefit of U.S. Provisional Patent Application No. 61/581,516, filed Dec. 29, 2011, all of which are incorporated herein by reference in their entirety.

FIELD

This application is related to golf club heads, in particular wood-type golf club heads having a hollow interior cavity.

BACKGROUND

A golf club set includes various types of clubs for use in different conditions or circumstances in which a ball is hit during a golf game. A set of clubs typically includes a driver for hitting the ball the longest distance on a course. Fairway woods, rescue clubs, and hybrid clubs can be used for hitting the ball shorter distances than the driver. A set of irons are used for hitting the ball within a range of distances typically shorter than the driver or woods.

Designers and manufacturers of wood-type golf club heads (e.g., drivers, fairway woods, rescue clubs, hybrid clubs, etc.) have sought to find mass savings opportunities within the club head structure. Discretionary mass generally refers to the mass of material that can be removed from various structures providing mass. In some cases, the mass is removed for the purpose of reducing overall club mass to allow for higher club head speeds. In other cases, the removed mass can be distributed elsewhere to other structures within the golf club head to achieve desired mass properties, or to allow for the addition of adjustability features which typically add mass to the club head.

The acoustical properties of golf club heads, e.g., the sound a golf club head generates upon impact with a golf ball, affect the overall feel of a golf club by providing instant auditory feedback to the user of the club. For example, the auditory feedback can affect the feel of the club by providing an indication as to how well the golf ball was struck by the club, thereby promoting user confidence in the club and himself.

The sound generated by a golf club head is based on the rate, or frequency, at which the golf club head vibrates upon impact with the golf ball. Generally, for wood-type golf clubs (as distinguished from iron-type golf clubs), particularly those made of steel or titanium alloys, a desired frequency is generally around 3,000 Hz and preferably greater than 3,200 Hz. A frequency less than 3,000 Hz may result in negative auditory feedback and thus a golf club with an undesirable feel.

Accordingly, it would be desirable to provide wood-type golf club heads having features that provide mass savings and opportunities to provide discretionary mass. It would also be desirable to increase the vibration frequencies of golf club heads having relatively large volumes, relatively thin walls, and other frequency reducing features in order to provide a golf club head that provides desirable feel through positive auditory feedback but without sacrificing the head's performance.

SUMMARY OF THE DESCRIPTION

Described herein are embodiments of wood-type golf club heads having a hollow body comprising a sole portion, a crown portion, a skirt portion, and a striking face. The golf club head body can include a front portion, rear portion, heel portion and toe portion. Examples of the golf club heads include wood-type golf club heads, such as drivers, fairway woods, rescue clubs, hybrid clubs, and the like.

In one aspect, the crown portion of the golf club head body includes at least a portion having a lattice-like structure comprising thin regions surrounded by a web of relatively thicker regions. In some examples of golf club heads constructed of metallic alloys (e.g., titanium alloys, steel alloys, aluminum alloys, etc.), the thin regions have a thickness of from about 0.3 mm to about 0.6 mm, such as from about 0.35 mm to about 0.5 mm. In some examples, the relatively thicker regions have a thickness of from about 0.5 mm to about 1.0 mm, such as from about 0.5 mm to about 0.7 mm.

In a second aspect, described herein are embodiments of wood-type golf club heads having at least one stiffening member extending within the internal portion of the head. For example, according to one embodiment, a wood-type golf club head can include a body that has at least one wall defining an interior cavity. The golf club head can also include at least one stiffening tube projecting inwardly from the at least one wall.

The foregoing and other features and advantages of the described golf club heads will become more apparent from the following detailed description, which proceeds with reference to the accompanying figures.

BRIEF DESCRIPTION OF THE DRAWINGS

The present invention is illustrated by way of example and not limitation in the figures of the accompanying drawings in which like references indicate similar elements.

DETAILED DESCRIPTION

The following disclosure describes embodiments of golf club heads for wood-type clubs (e.g., drivers, fairway woods, rescue clubs, hybrid clubs, etc.) that incorporate structures providing improved weight distribution, improved sound characteristics, improved adjustability features, and/or combinations of the foregoing characteristics. The disclosed embodiments should not be construed as limiting in any way. Instead, the present disclosure is directed toward all novel and nonobvious features and aspects of the various disclosed embodiments, alone and in various combinations and subcombinations with one another. Furthermore, any features or aspects of the disclosed embodiments can be used in various combinations and subcombinations with one another. The disclosed embodiments are not limited to any specific aspect or feature or combination thereof, nor do the disclosed embodiments require that any one or more specific advantages be present or problems be solved.

The present disclosure makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references may be used to facilitate discussion of the drawings but are not intended to be limiting. For example, certain terms may be used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. Accordingly, the following detailed description shall not to be construed in a limiting sense.

I. Golf Club Heads

A. Normal Address Position

Figure 1:
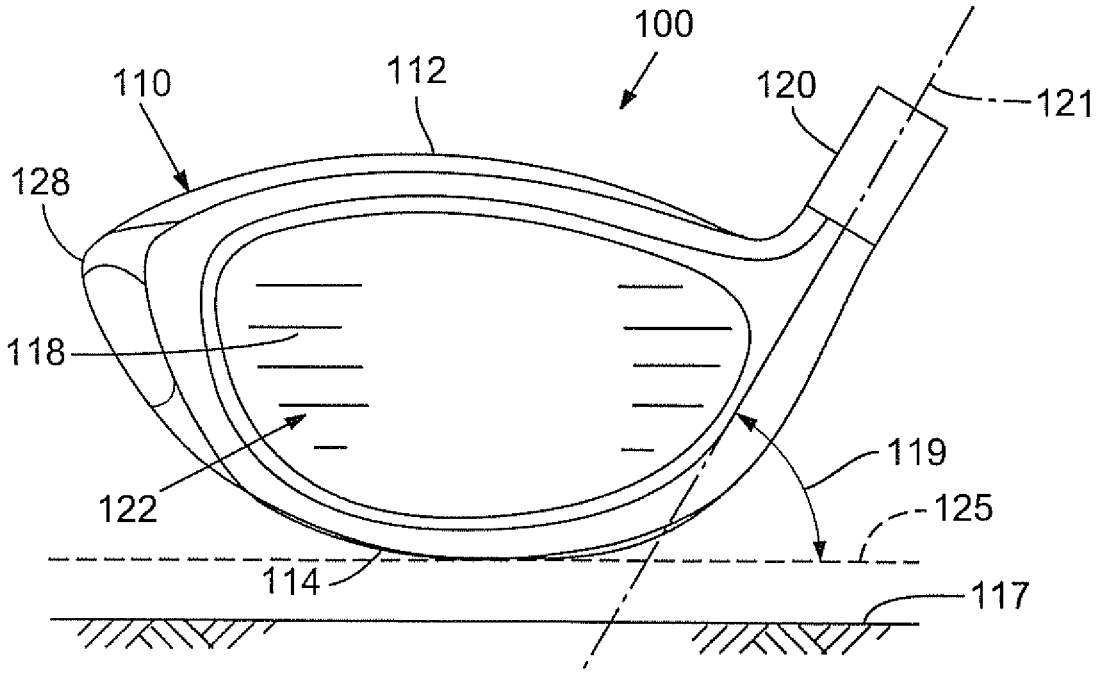
FIG. 1 is a front elevation view of an exemplary embodiment of a golf club head.
Figure 2:
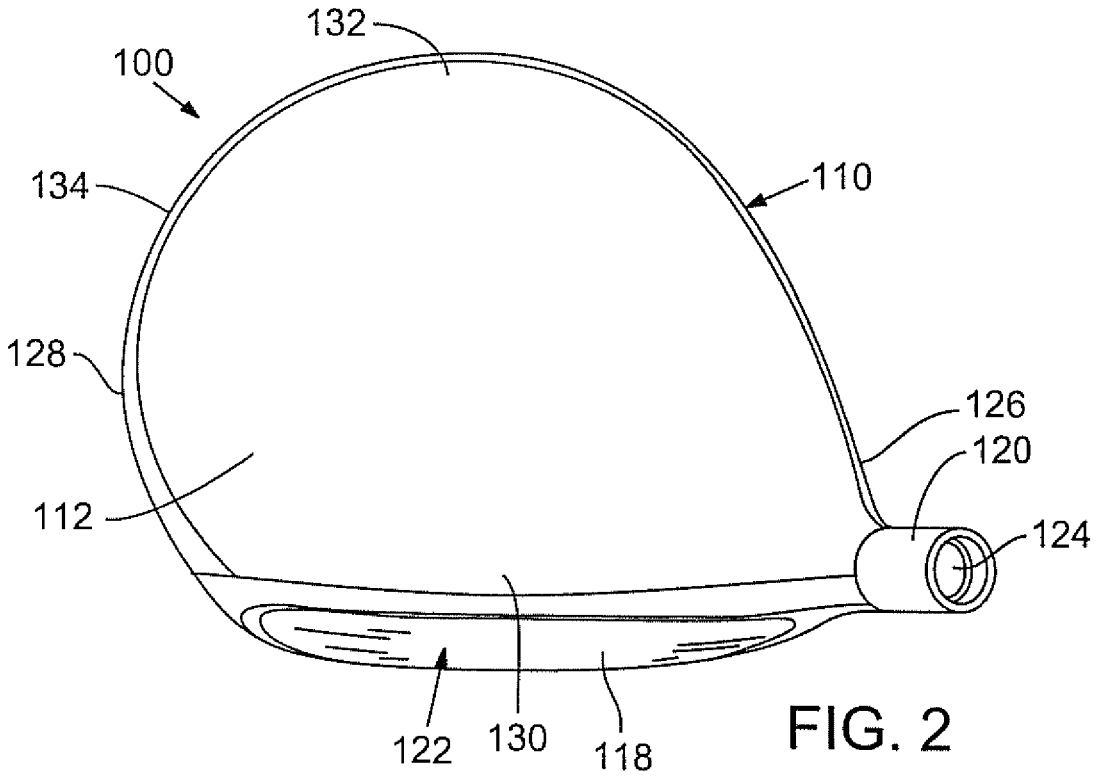
FIG. 2 is a top plan view of the golf club head of FIG. 1.
Figure 3:
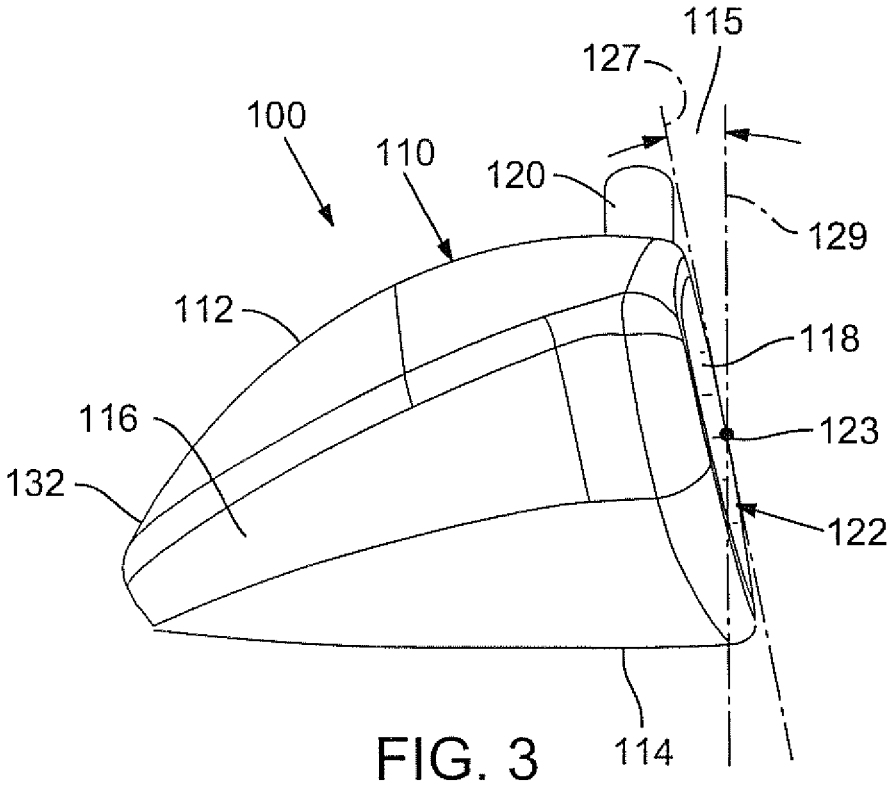
FIG. 3 is a side elevation view from a toe side of the golf club head of FIG. 1.

Club heads and many of their physical characteristics disclosed herein will be described using "normal address position" as the club head reference position, unless otherwise indicated. FIGS. 1-3 illustrate one embodiment of a wood-type golf club head at normal address position. FIG. 1 illustrates a front elevation view of golf club head 100, FIG. 2 illustrates a top plan view of the golf club head 100, and FIG. 3 illustrates a side elevation view of the golf club head 100 from the toe side. By way of preliminary description, the club head 100 includes a hosel 120 and a ball striking club face 118. At normal address position, the club head 100 is positioned on a plane 125 above and parallel to a ground plane 117.

As used herein, "normal address position" means the club head position wherein a vector normal to the center of the club face 118 lies in a first vertical plane (a vertical plane is perpendicular to the ground plane 117), the centerline axis 121 of the club shaft lies in a second vertical plane, and the first vertical plane and the second vertical plane perpendicularly intersect.

B. Club Head Features

A wood-type golf club head, such as the golf club head 100 shown in FIGS. 1-3, includes a hollow body 110 defining a crown portion 112, a sole portion 114, a skirt portion 116, and a ball striking club face 118. The ball striking club face 118 can be integrally formed with the body 110 or attached to the body. The body 110 further includes a hosel 120, which defines a hosel bore 124 adapted to receive a golf club shaft. The body 110 further includes a heel portion 126, a toe portion 128, a front portion 130, and a rear portion 132.

The club head 100 also has a volume, typically measured in cubic-centimeters ($cm^3$), equal to the volumetric displacement of the club head, assuming any apertures are sealed by a substantially planar surface, using the method described in the Procedure for Measuring the Club Head Size of Wood Clubs, Revision 1.0, Section 5 (Nov. 21, 2003), as specified by the United States Golf Association (USGA) and the R&A Rules Limited (R&A).

As used herein, "crown" means an upper portion of the club head above a peripheral outline 134 of the club head as viewed from a top-down direction and rearward of the topmost portion of a ball striking surface 122 of the ball striking club face 118. As used herein, "sole" means a lower portion of the club head 100 extending upwards from a lowest point of the club head when the club head is at the normal address position. In some implementations, the sole 114 extends approximately 50% to 60% of the distance from the lowest point of the club head to the crown 112. In other implementations, the sole 114 extends upwardly from the lowest point of the golf club head 110 a shorter distance. Further, the sole 114 can define a substantially flat portion extending substantially horizontally relative to the ground 117 when in normal address position or can have an arced or convex shape as shown in FIG. 1. As used herein, "skirt" means a side portion of the club head 100 between the crown 112 and the sole 114 that extends across a periphery 134 of the club head, excluding the striking surface 122, from the toe portion 128, around the rear portion 132, to the heel portion 126. As used herein, "striking surface" means a front or external surface of the ball striking club face 118 configured to impact a golf ball. In some embodiments, the striking surface 122 can be a striking plate attached to the body 110 using known attachment techniques, such as welding. Further, the striking surface 122 can have a variable thickness. In certain embodiments, the striking surface 122 has a bulge and roll curvature (discussed more fully below).

The body 110, or any parts thereof, can be made from a metal alloy (e.g., an alloy of titanium, an alloy of steel, an alloy of aluminum, and/or an alloy of magnesium), a composite material (e.g., a graphite or carbon fiber composite) a ceramic material, or any combination thereof. The crown 112, sole 114, skirt 116, and ball striking club face 118 can be integrally formed using techniques such as molding, cold forming, casting, and/or forging. Alternatively, any one or more of the crown 112, sole 114, skirt 116, or ball striking club face 118 can be attached to the other components by known means (e.g., adhesive bonding, welding, and the like).

In some embodiments, the striking face 118 is made of a composite material, while in other embodiments, the striking face 118 is made from a metal alloy (e.g., an alloy of titanium, steel, aluminum, and/or magnesium), ceramic material, or a combination of composite, metal alloy, and/or ceramic materials.

When at normal address position, the club shaft extends along the club shaft axis 121 and is disposed at a lie angle 119 relative to the plane 125 parallel to the ground plane 117 (as shown in FIG. 1) and the club face has a loft angle 115 (as shown in FIG. 3). Referring to FIG. 1, the lie angle 119 refers to the angle between the centerline axis 121 of the club shaft and the ground plane 117 at normal address position. Referring to FIG. 3, loft angle 115 refers to the angle between a tangent line 127 to the club face 118 and a vector 129 normal to the ground plane at normal address position.

Figure 4:
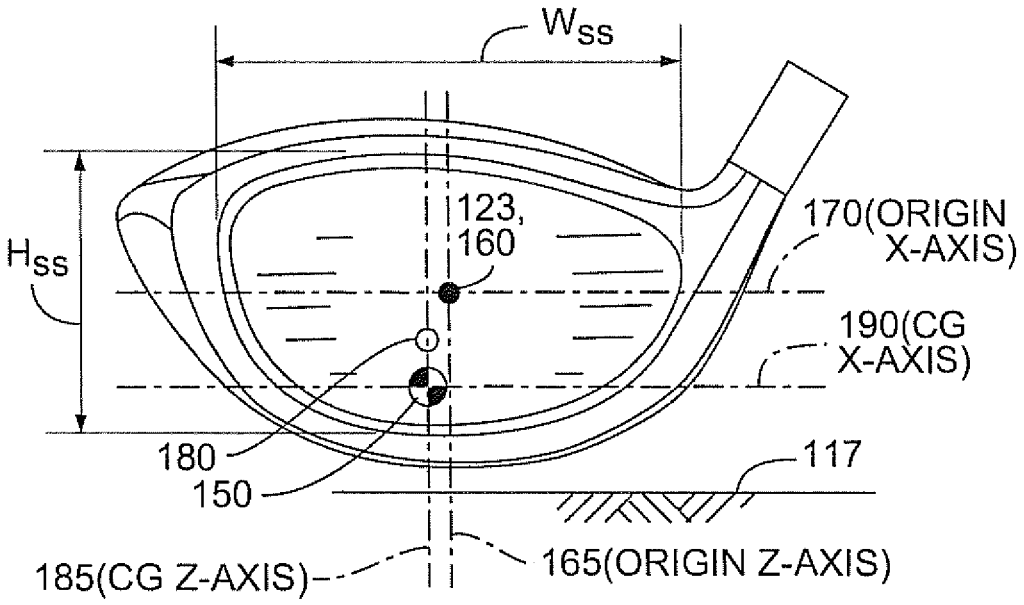
FIG. 4 is a front elevation view of the golf club of FIG. 1 illustrating club head origin and center of gravity origin coordinate systems.
Figure 5:
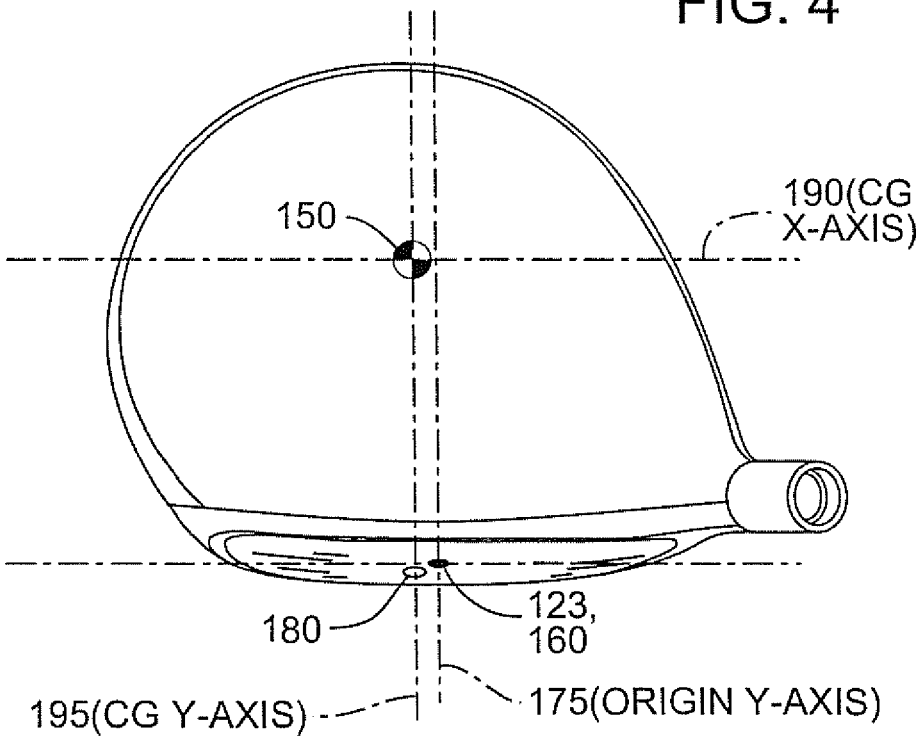
FIG. 5 is a top plan view of the golf club of FIG. 1 illustrating the club head origin and center of gravity origin coordinate systems.
Figure 6:
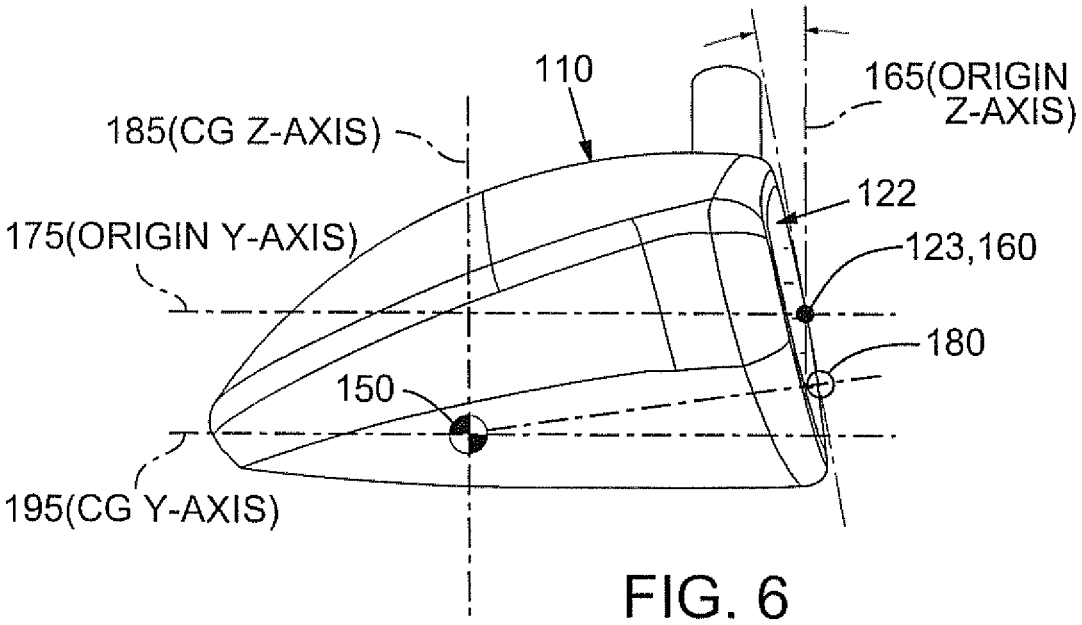
FIG. 6 is a side elevation view from a toe side of the golf club of FIG. 1 illustrating the club head origin and center of gravity origin coordinate systems.

FIGS. 4-6 illustrate coordinate systems that can be used in describing features of the disclosed golf club head embodiments. FIG. 4 illustrates a front elevation view of the golf club head 100, FIG. 5 illustrates a top plan view of the golf club head 100, and FIG. 6 illustrates a side elevation view of the golf club head 100 from the toe side. As shown in FIGS. 4-6, a center 123 is disposed on the striking surface 122. For purposes of this description, the center 123 is defined as the intersection of the midpoints of a height ($H_{ss}$) and a width ($W_{ss}$) of the striking surface 122. Both $H_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body. $H_{ss}$ is the distance from the periphery proximate to the sole portion of $S_{ss}$ (also referred to as the bottom radius of the club face) to the periphery proximate to the crown portion of $S_{ss}$ (also referred to as the top radius of the club face) measured in a vertical plane (perpendicular to ground) that extends through the center 123 of the face (e.g., this plane is substantially normal to the x-axis). Similarly, $W_{ss}$ is the distance from the periphery proximate to the heel portion of $S_{ss}$ to the periphery proximate to the toe portion of $S_{ss}$ measured in a horizontal plane (e.g., substantially parallel to ground) that extends through the center 123 of the face (e.g., this plane is substantially normal to the z-axis). In other words, the center 123 along the z-axis corresponds to a point that bisects into two equal parts a line drawn from a point just on the inside of the top radius of the striking surface (and centered along the x-axis of the striking surface) to a point just on the inside of the bottom radius of the face plate (and centered along the x-axis of the striking surface). For purposes of this description, the center 123 is also referred to as the "geometric center" of the golf club striking surface 122. See also USGA. "Procedure for Measuring the Flexibility of a Golf Clubhead," Revision 2.0 for the methodology to measure the geometric center of the striking face.

C. Golf Club Head Coordinates

Referring to FIGS. 4-6, a club head origin coordinate system is defined such that the location of various features of the club head (including a club head center-of-gravity (CG) 150) can be determined. A club head origin 160 is illustrated on the club head 100 positioned at the center 123 of the striking surface 122.

The head origin coordinate system defined with respect to the head origin 160 includes three axes: a z-axis 165 extending through the head origin 160 in a generally vertical direction relative to the ground 117 when the club head 100 is at the normal address position; an x-axis 170 extending through the head origin 160 in a toe-to-heel direction generally parallel to the striking surface 122 (e.g., generally tangential to the striking surface 122 at the center 123) and generally perpendicular to the z-axis 165; and a y-axis 175 extending through the head origin 160 in a front-to-back direction and generally perpendicular to the x-axis 170 and to the z-axis 165. The x-axis 170 and the y-axis 175 both extend in generally horizontal directions relative to the ground 117 when the club head 100 is at the normal address position. The x-axis 170 extends in a positive direction from the origin 160 towards the heel 126 of the club head 100. The y-axis 175 extends in a positive direction from the head origin 160 towards the rear portion 132 of the club head 100. The z-axis 165 extends in a positive direction from the origin 160 towards the crown 112.

D. Center of Gravity

Generally, the center of gravity (CG) of a golf club head is the point at which the entire weight of the golf club head may be considered as concentrated so that if supported at this point the head would remain in equilibrium in any position.

Referring to FIGS. 4-6, a CG 150 is shown as a point inside the body 110 of the club head 100. The location of the club CG 150 can also be defined with reference to the club head origin coordinate system. For example, and using millimeters as the unit of measure, a CG 150 that is located 3.2 mm from the head origin 160 toward the toe of the club head along the x-axis, 36.7 mm from the head origin 160 toward the rear of the club head along the y-axis, and 4.1 mm from the head origin 160 toward the sole of the club head along the z-axis can be defined as having a $CG_x$ of −3.2 mm, a $CG_y$ of −36.7 mm, and a $CG_z$ of −4.1 mm.

The CG can also be used to define a coordinate system with the CG as the origin of the coordinate system. For example, and as illustrated in FIGS. 4-6, the CG origin coordinate system defined with respect to the CG origin 150 includes three axes: a CG z-axis 185 extending through the CG 150 in a generally vertical direction relative to the ground 117 when the club head 100 is at normal address position; a CG x-axis 190 extending through the CG origin 150 in a toe-to-heel direction generally parallel to the striking surface 122, and generally perpendicular to the CG z-axis 185; and a CG y-axis 195 extending through the CG origin 150 in a front-to-back direction and generally perpendicular to the CG x-axis 190 and to the CG z-axis 185. The CG x-axis 190 and the CG y-axis 195 both extend in generally horizontal directions relative to the ground 117 when the club head 100 is at normal address position. The CG x-axis 190 extends in a positive direction from the CG origin 150 to the heel 126 of the club head 100. The CG y-axis 195 extends in a positive direction from the CG origin 150 towards the rear portion 132 of the golf club head 100. The CG z-axis 185 extends in a positive direction from the CG origin 150 towards the crown 112. Thus, the axes of the CG origin coordinate system are parallel to corresponding axes of the head origin coordinate system. In particular, the CG z-axis 185 is parallel to z-axis 165, CG x-axis 190 is parallel to x-axis 170, and CG y-axis 195 is parallel to y-axis 175.

As best shown in FIG. 6, FIGS. 4-6 also show a projected CG point 180 on the golf club head striking surface 122. The projected CG point 180 is the point on the striking surface 122 that intersects with a line passes through the CG 150 and that is normal to a tangent line of the ball striking club face 118 at the projected CG point 180. This projected CG point 180 can also be referred to as the "zero-torque" point because it indicates the point on the ball striking club face 118 that is centered with the CG 150. Thus, if a golf ball makes contact with the club face 118 at the projected CG point 180, the golf club head will not twist about any axis of rotation since no torque is produced by the impact of the golf ball.

E. Mass Moments of Inertia

Referring to FIGS. 4-6, golf club head moments of inertia are typically defined about the three CG axes that extend through the golf club head center-of-gravity 150. For example, a moment of inertia about the golf club head CG x-axis 190 can be calculated by the following equation $$I_{xx}=\int(z^2+y^2)dm \quad (1)$$

where y is the distance from a golf club head CG xz-plane to an infinitesimal mass, dm, and z is the distance from a golf club head CG xy-plane to the infinitesimal mass, dm. The golf club head CG xz-plane is a plane defined by the golf club head CG x-axis 190 and the golf club head CG z-axis 185. The CG xy-plane is a plane defined by the golf club head CG x-axis 190 and the golf club head CG y-axis 195.

The moment of inertia about the CG x-axis ($I_{xx}$) is an indication of the ability of the golf club head to resist twisting about the CG x-axis. A higher moment of inertia about the CG x-axis ($I_{xx}$) indicates a higher resistance to the upward and downward twisting of the golf club head 100 resulting from high and low off-center impacts with the golf ball.

Similarly, a moment of inertia about the golf club head CG z-axis 185 can be calculated by the following equation $$I_{zz}=\int(x^2+y^2)dm \quad (1)$$

where x is the distance from a golf club head CG yz-plane to an infinitesimal mass, dm, and y is the distance from a golf club head CG xz-plane to the infinitesimal mass, dm. The CG yz-plane is a plane defined by the golf club head CG y-axis 195 and the golf club head CG z-axis 190. The golf club head CG xz-plane is a plane defined by the golf club head CG x-axis 190 and the golf club head CG z-axis 185.

The moment of inertia about the CG z-axis ($I_{zz}$) is an indication of the ability of the golf club head to resist twisting about the CG z-axis. A higher moment of inertia about the CG z-axis ($I_{zz}$) indicates a higher resistance to the toeward and heelward twisting of the golf club head 100 resulting from toe-side and heel-side off-center impacts with the golf ball.

F. Adjusting Golf Club Head Mass

Golf club heads can use one or more weight plates, weight pads, or weight ports in order to change the mass moment of inertia of the golf club head, to change the center of gravity to a desired location, or for other purposes. For example, certain embodiments of the disclosed golf club heads have one or more integral weight pads cast into the golf club head at predetermined locations (e.g., in the sole of the golf club head) that change the location of the club head's center-of-gravity. Also, epoxy can be added to the interior of the club head through the club head's hosel opening to obtain a desired weight distribution. Alternatively, one or more weights formed of high-density materials (e.g., tungsten or tungsten alloy) can be attached to the sole or other portions of the golf club head. Such weights can be permanently attached to the club head. Furthermore, the shape of such weights can vary and is not limited to any particular shape. For example, the weights can have a disc, elliptical, cylindrical, or other shape.

The golf club head 100 can also define one or more weight ports formed in the body 110 that are configured to receive one or more weights. For example, one or more weight ports can be disposed in the crown 112, the sole 114, and/or the skirt 116. The weight port can have any of a number of various configurations to receive and retain any of a number of weights or weight assemblies, such as described in U.S. Pat. Nos. 7,407,447 and 7,419,441, which are incorporated herein by reference. Inclusion of one or more weights in the weight port(s) provides a customized club head mass distribution with corresponding customized moments of inertia and center-of-gravity locations. Adjusting the location of the weight port(s) and the mass of the weights and/or weight assemblies provides various possible locations of center-of-gravity and various possible mass moments of inertia using the same club head.

G. Adjusting Golf Club Head Lie, Loft, and Face Angles

In some implementations, an adjustable mechanism is provided on the sole 114 to "decouple" the relationship between face angle and hosel/shaft loft, e.g., to allow for separate adjustment of square loft and face angle of a golf club. For example, some embodiments of the golf club head 100 include an adjustable sole portion that can be adjusted relative to the club head body 110 to raise and lower the rear end of the club head relative to the ground. Further detail concerning the adjustable sole portion is provided in U.S. Patent Application Publication No. 2011/0312437, which is incorporated herein by reference.

For example, FIGS. 13-17 illustrate a golf club head 8000 according to an embodiment that also includes an adjustable sole portion. As shown in FIGS. 13A-13F, the club head 8000 comprises a club head body 8002 having a heel 8005, a toe 8007, a rear end 8006, a forward striking face 8004, a top portion or crown 8021, and a bottom portion or sole 8022. The body also includes a hosel 8008 for supporting a shaft (not shown). The sole 8022 defines a leading edge surface portion 8024 adjacent the lower edge of the striking face 8004 that extends transversely across the sole 8022 (e.g., the leading edge surface portion 8024 extends in a direction from the heel 8005 to the toe 8007 of the club head body). The hosel 8008 can be adapted to receive a removable shaft sleeve 8009, as disclosed herein.

Figure 14:
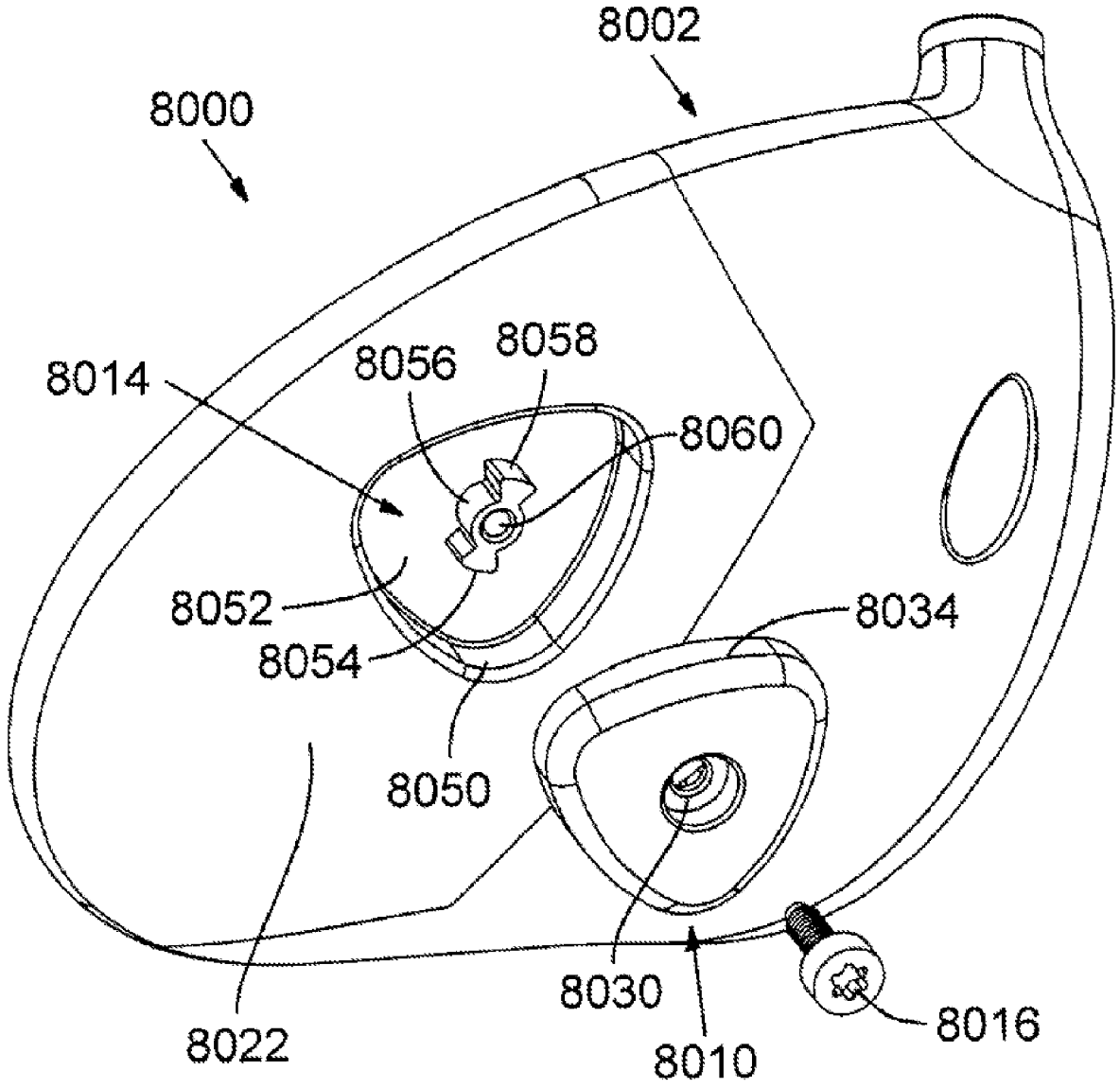
FIG. 14 is an exploded perspective view of the golf club head of FIG. 13A.

The sole 8022 further includes an adjustable sole portion 8010 (also referred to as a sole piece) that can be adjusted relative to the club head body 8002 to a plurality of rotational positions to raise and lower the rear end 8006 of the club head relative to the ground. This can rotate the club head about the leading edge surface portion 8024 of the sole 8022, changing the sole angle. As best shown in FIG. 14, the sole 8022 of the club head body 8002 can be formed with a recessed cavity 8014 that is shaped to receive the adjustable sole portion 8010.

Figure 16A:
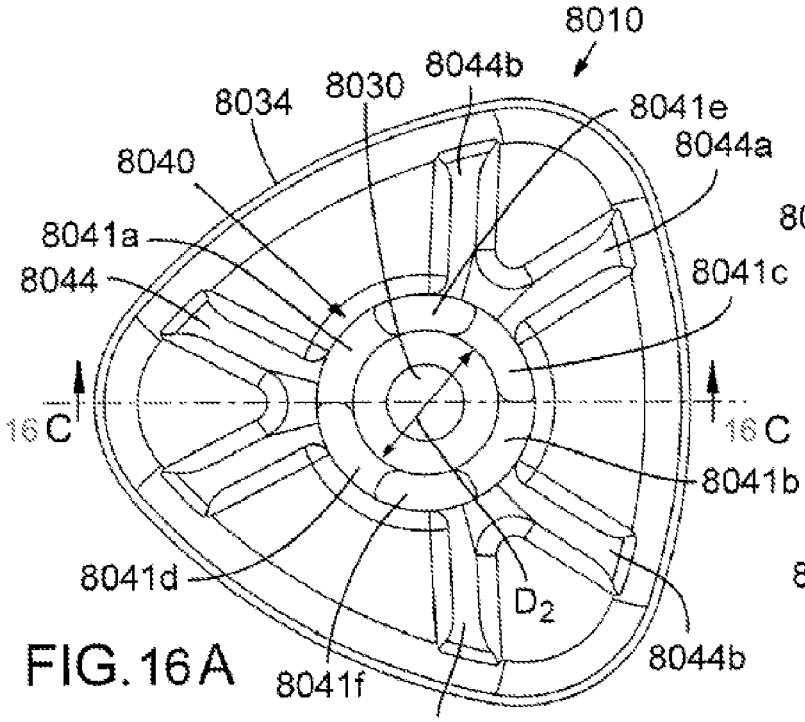
FIG. 16A is top view of an adjustable sole portion of the golf club head of FIG. 13A.
Figure 16B:
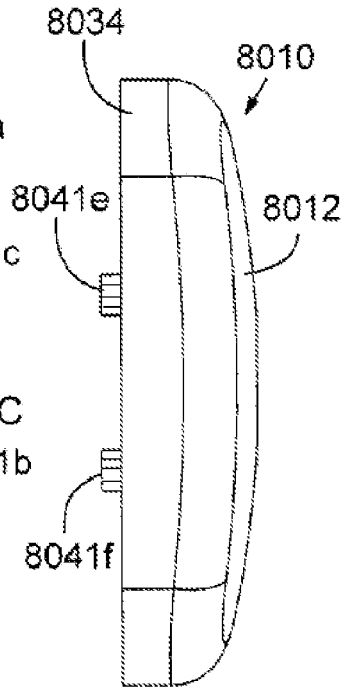
FIG. 16B is a side view of the adjustable sole portion of FIG. 16A.
Figure 16C:
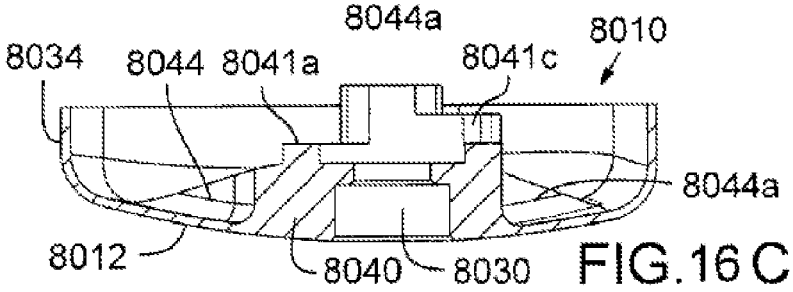
FIG. 16C is a cross-sectional side view of the adjustable sole portion of FIG. 16A.
Figure 16D:
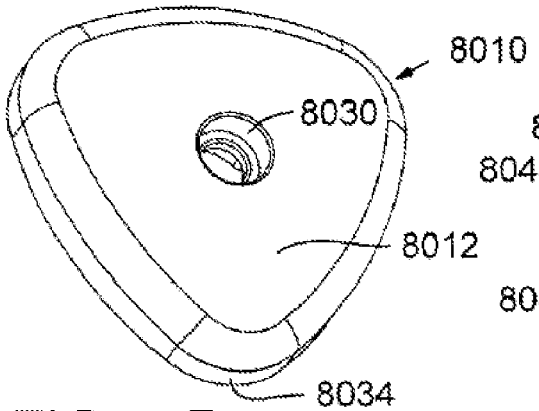
FIG. 16D is a perspective view of the bottom of the adjustable sole portion of FIG. 16A.

As best shown in FIG. 16A, the adjustable sole portion 8010 can be triangular. In other embodiments, the adjustable sole portion 8010 can have other shapes, including a rectangle, square, pentagon, hexagon, circle, oval, star or combinations thereof. Desirably, although not necessarily, the sole portion 8010 is generally symmetrical about a center axis as shown. As best shown in FIG. 16C, the sole portion 8010 has an outer rim 8034 extending upwardly from the edge of a bottom wall 8012. The rim 8034 can be sized and shaped to be received within the walls of the recessed cavity 8014 with a small gap or clearance between the two when the adjustable sole portion 8010 is installed in the body 8002. The bottom wall 8012 and outer rim 8034 can form a thin-walled structure as shown. At the center of the bottom surface 8012 can be a recessed screw hole 8030 that passes completely through the adjustable sole portion 8010.

A circular, or cylindrical, wall 8040 can surround the screw hole 8030 on the upper/inner side of the adjustable sole portion 8010. The wall 8040 can also be triangular, square, pentagonal, etc., in other embodiments. The wall 8040 can be comprised of several sections 8041 having varying heights. Each section 8041 of the wall 8040 can have about the same width and thickness, and each section 8041 can have the same height as the section diametrically across from it. In this manner, the circular wall 8040 can be symmetrical about the centerline axis of the screw hole 8030. Furthermore, each pair of wall sections 8041 can have a different height than each of the other pairs of wall sections. Each pair of wall sections 8041 is sized and shaped to mate with corresponding sections on the club head to set the sole portion 8010 at a predetermined height, as further discussed below.

Figure 16E:
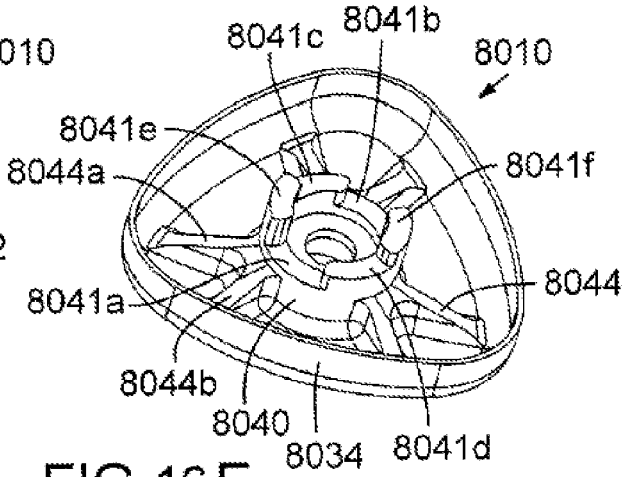
FIG. 16E is a perspective view of the top of the adjustable sole portion of FIG. 16A.
Figure 17A:
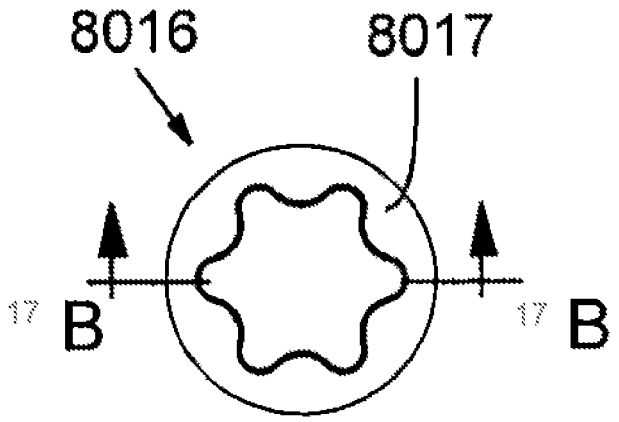
FIG. 17A is a plan view of the head of a screw that can be used to secure the adjustable sole portion of FIG. 16A to a club head.
Figure 17B:
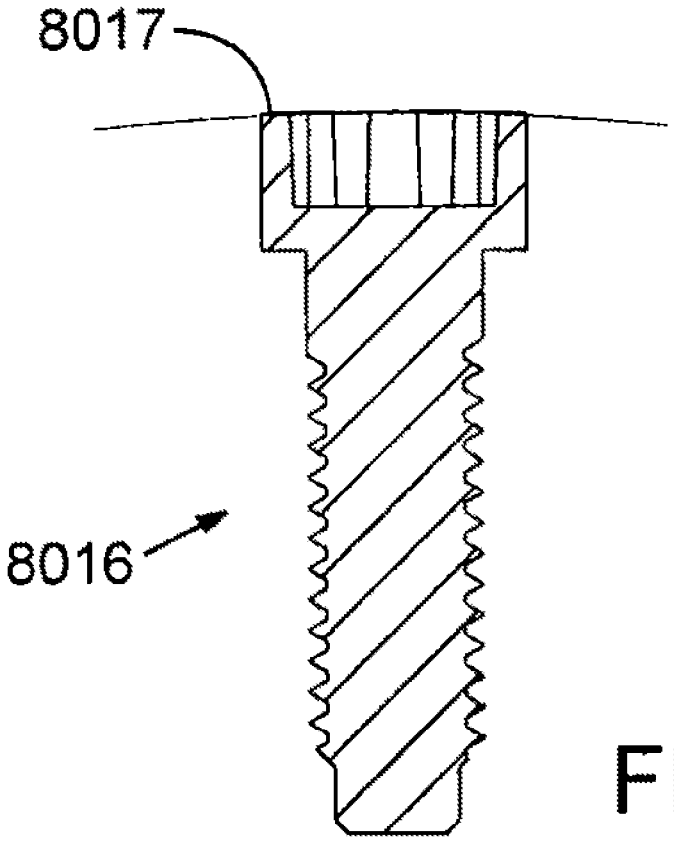
FIG. 17B is a cross-sectional view of the screw of FIG. 17A, taken along line A-A.

For example, in the triangular embodiment of the adjustable sole portion 8010 shown in FIG. 16E, the circular wall 8040 has six wall sections 8041*a, b, c, d, e* and *f* that make up three pairs of wall sections, each pair having different heights. Each pair of wall sections 8041 project upward a different distance from the upper/inner surface of the adjustable sole portion 8010. Namely, a first pair is comprised of wall sections 8041*a* and 8041*b*; a second pair is comprised of 8041*c* and 8041*d* that extend past the first pair; and a third pair is comprised of wall sections 8041*e* and 8041*f* that extend past the first and second pairs. Each pair of wall sections 8041 desirably is symmetrical about the centerline axis of the screw hole 8030. The tallest pair of wall sections 8041*e*, 8041*f* can extend beyond the height of the outer rim 8034, as shown in FIGS. 16B and 16C. The number of wall section pairs (three) desirably equals the number of planes of symmetry (three) of the overall shape (see FIG. 16A) of the adjustable sole portion 8010. As explained in more detail below, a triangular adjustable sole portion 8010 can be installed into a corresponding triangular recessed cavity 8014 in three different orientations, each of which aligns one of the pairs of wall sections 8041 with mating surfaces on the sole portion 8010 to adjust the sole angle.

The adjustable sole portion 8010 can also include any number ribs 8044, as shown in FIG. 16E, to add structural rigidity. Such increased rigidity is desirable because, when installed in the body 8002, the bottom wall 8012 and parts of the outer rim 8034 can protrude below the surrounding portions of the sole 8022 and therefore can take the brunt of impacts of the club head 8000 against the ground or other surfaces. Furthermore, because the bottom wall 8012 and outer rim 8034 of the adjustable sole portion 8010 are desirably made of thin-walled material to reduce weight, adding structural ribs is a weight-efficient means of increasing rigidity and durability.

The triangular embodiment of the adjustable sole portion 8010 shown in FIG. 16E includes three pairs of ribs 8044 extending from the circular wall 8040 radially outwardly toward the outer rim 8034. The ribs 8044 desirably are angularly spaced around the center wall 8040 in equal intervals. The ribs 8044 can be attached to the lower portion of the circular wall 8040 and taper in height as they extend outward along the upper/inner surface of the bottom wall 8012 toward the outer wall 8034. As shown, each rib can comprise first and second sections 8044*a*, 8044*b* that extent from a common apex at the circular wall 8040 to separate locations on the outer wall 8034. In alternative embodiments, a greater or fewer number of ribs 8044 can be used (e.g., greater or fewer than three ribs 8044).

Figure 15B:
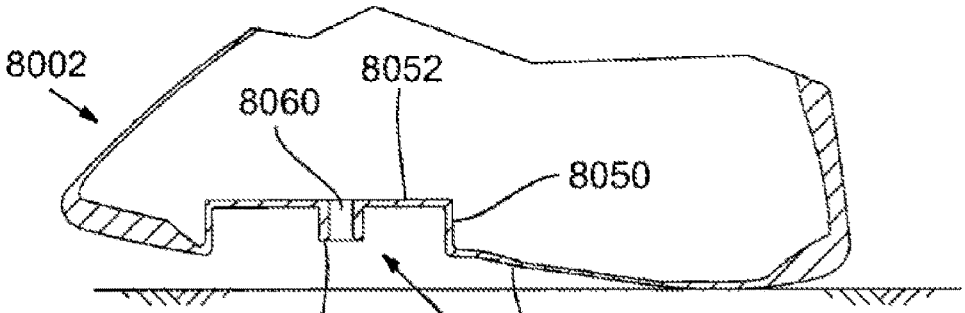
FIG. 15B is a cross-sectional view of the golf club head of FIG. 15A, taken along line 15B-15B.
Figure 15A:
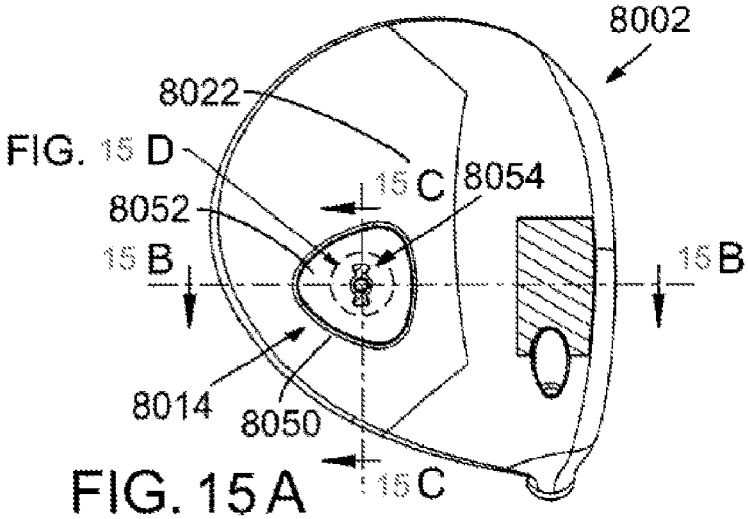
FIG. 15A is a bottom view of a body of the golf club head of FIG. 13A, showing a recessed cavity in the sole.
Figure 15D:
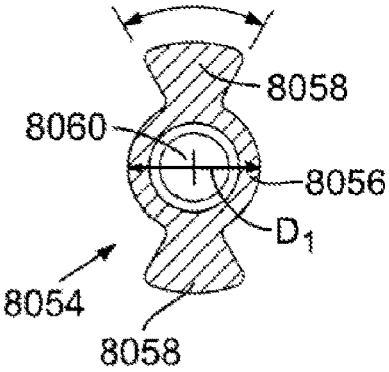
FIG. 15D is an enlarged cross-sectional view of a raised platform or projection formed in the sole of the club head of FIG. 15A.
Figure 15C:
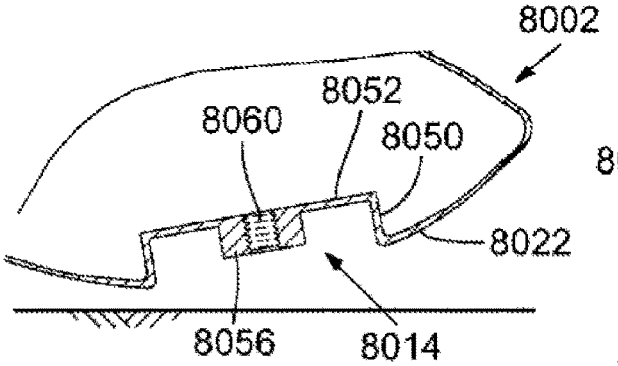
FIG. 15C is a cross-sectional view of the golf club head of FIG. 15A, taken along line 15C-15C.

As shown in FIG. 15A-C, the recessed cavity 8014 in the sole 8022 of the body 8002 can be shaped to fittingly receive the adjustable sole portion 8010. The cavity 8014 can include a cavity side wall 8050, an upper surface 8052, and a raised platform, or projection, 8054 extending down from the upper surface 8052. The cavity wall 8050 can be substantially vertical to match the outer rim 8034 of the adjustable sole portion 8010 and can extend from the sole 8022 up to the upper surface 8052. The upper surface 8052 can be substantially flat and proportional in shape to the bottom wall 8012 of the adjustable sole portion 8010. As best shown in FIG. 14, the cavity side wall 8050 and upper surface 8052 can define a triangular void that is shaped to receive the sole portion 8010. In alternative embodiments, the cavity 8014 can be replaced with an outer triangular channel for receiving the outer rim 8034 and a separate inner cavity to receive the wall sections 8041. The cavity 8014 can have various other shapes, but desirably is shaped to correspond to the shape of the sole portion 8010. For example, if the sole portion 8010 is square, then the cavity 8014 desirably is square.

Figure 15E:
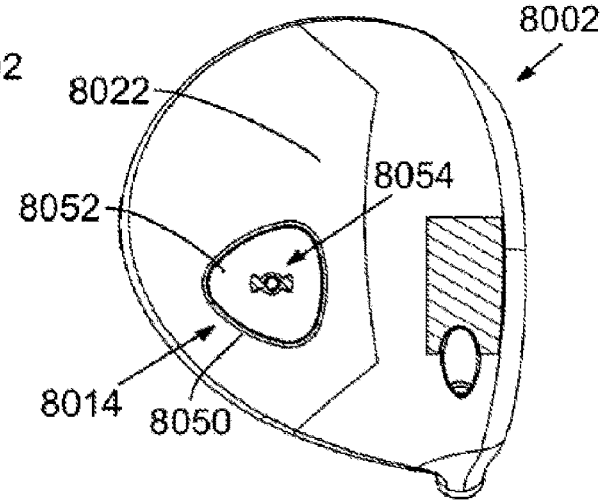
FIG. 15E is a bottom view of a body of the golf club head of FIG. 13A, showing an alternative orientation of the raised platform or projection.

As shown in FIG. 15A, the raised platform 8054 can be geometrically centered on the upper surface 8052. The platform 8054 can be bowtie-shaped and include a center post 8056 and two flared projections, or ears, 8058 extending from opposite sides of the center post, as shown in FIG. 15D. The platform 8054 can also be oriented in different rotational positions with respect to the club head body 8002. For example, FIG. 15E shows an embodiment wherein the platform 8054 is rotated 90-degrees compared to the embodiment shown in FIG. 15A. The platform can be more or less susceptible to cracking or other damage depending on the rotational position. In particular, durability tests have shown that the platform is less susceptible to cracking in the embodiment shown in FIG. 15E compared to the embodiment shown in FIG. 15A.

In other embodiments, the shape of the raised platform 8054 can be rectangular, wherein the center post and the projections collectively form a rectangular block. The projections 8058 can also have parallel sides rather than sides that flare out from the center post. The center post 8056 can include a threaded screw hole 8060 to receive a screw 8016 (see FIG. 17) for securing the sole portion 8010 to the club head. In some embodiments, the center post 8056 is cylindrical, as shown in FIG. 15D. The outer diameter D1 of a cylindrical center post 8056 (FIG. 15D) can be less than the inner diameter D2 of the circular wall 8040 of the adjustable sole portion 8010 (FIG. 16A), such that the center post can rest inside the circular wall when the adjustable sole portion 8010 is installed. In other embodiments, the center post 8056 can be triangular, square, hexagonal, or various other shapes to match the shape of the inner surface of the wall 8040 (e.g., if the inner surface of wall 8040 is non-cylindrical).

The projections 8058 can have a different height than the center post 8056, that is to say that the projections can extend downwardly from the cavity roof 8052 either farther than or not as far as the center post. In the embodiment shown in FIG. 14, the projections and the center post have the same height. FIG. 14 also depicts one pair of projections 8058 extending from opposite sides of the center post 8056. Other embodiments can include a set of three or more projections spaced apart around the center post. Because the embodiment shown in FIG. 14 incorporates a triangular shaped adjustable sole portion 8010 having three pairs of varying height wall sections 8041, the projections 8058 each occupy about one-sixth of the circumferential area around of the center post 8056. In other words, each projection 8058 spans a roughly 60-degree section (see FIG. 15D) to match the wall sections 8041 that also each span a roughly 60-degree section of the circular wall 8040 (see FIG. 16A). The projections 8058 do not need to be exactly the same circumferential width as the wall sections 8041 and can be slightly narrower that the width of the wall sections. The distance from the centerline axis of the screw hole 8060 to the outer edge of the projections 8058 can be at least as great as the inner radius of the circular wall 8040, and desirably is at least as great as the outer radius of the circular wall 8040 to provide a sufficient surface for the ends of the wall sections 8041 to seat upon when the adjustable sole portion 8010 is installed in the body 8002.

A releasable locking mechanism or retaining mechanism desirably is provided to lock or retain the sole portion 8010 in place on the club head at a selected rotational orientation of the sole portion. For example, at least one fastener can extend through the bottom wall 8012 of the adjustable sole portion 8010 and can attach to the recessed cavity 8014 to secure the adjustable sole portion to the body 8002. In the embodiment shown in FIG. 14, the locking mechanism comprises a screw 8016 that extends through the recessed screw hole 8030 in the adjustable sole portion 8010 and into a threaded opening 8060 in the recessed cavity 8014 in the sole 8022 of the body 8002. In other embodiments, more than one screw or another type of fastener can be used to lock the sole portion in place on the club head.

In the embodiment shown in FIG. 14, the adjustable sole portion 8010 can be installed into the recessed cavity 8014 by aligning the outer rim 8034 with the cavity wall 8050. As the outer rim 8034 telescopes inside of the cavity wall 8050, the center post 8056 can telescope inside of the circular wall 8040. The matching shapes of the outer rim 8034 and the cavity wall 8050 can align one of the three pairs of wall sections 8041 with the pair of projections 8058. As the adjustable sole portion 8010 continues to telescope into the recessed cavity 8014, one pair of wall sections 8041 will abut the pair of projections 8058, stopping the adjustable sole portion from telescoping any further into the recessed cavity. The cavity wall 8050 can be deep enough to allow the outer rim 8034 to freely telescope into the recessed cavity without abutting the cavity roof 8052, even when the shortest pair of wall sections 8041*a*, 8041*b* abuts the projections 8058. While the wall sections 8041 abut the projections 8058, the screw 8016 can be inserted and tightened as described above to secure the components in place. Even with only one screw in the center, as shown in FIG. 13D, the adjustable sole portion 8010 is prevented from rotating by its triangular shape and the snug fit with the similarly shaped cavity wall 8050.

Figure 13A:
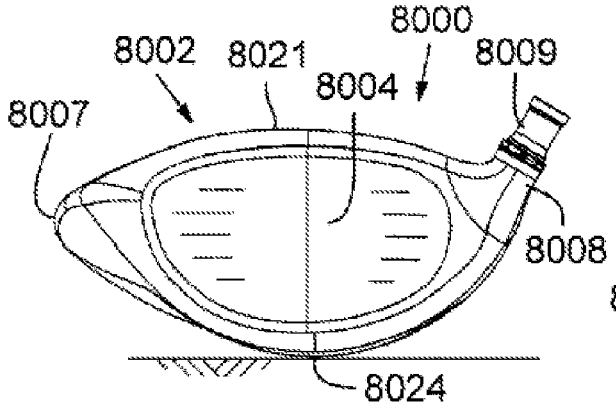
FIG. 13A is a front view of a golf club head, according to another embodiment.
Figure 13B:
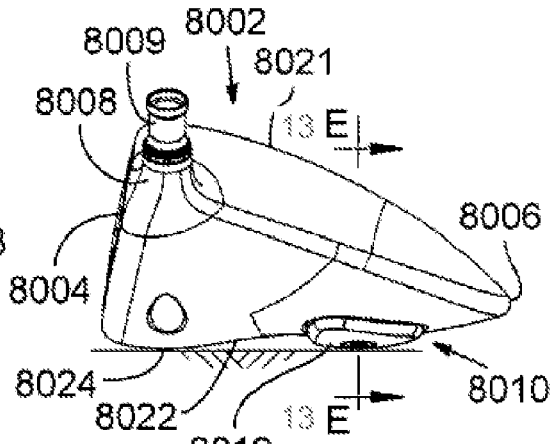
FIG. 13B is a side view of the golf club head of FIG. 13A.
Figure 13C:
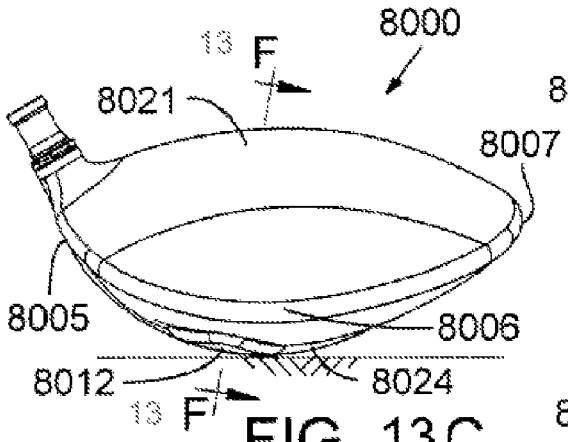
FIG. 13C is a rear view of the golf club head of FIG. 13A.

As best shown in FIG. 13C, the adjustable sole portion 8010 can have a bottom surface 8012 that is curved (see also FIG. 16B) to match the curvature of the leading surface portion 8024 of the sole 8022. In addition, the upper surface 8017 of the head of the screw 8016 can be curved (see FIG. 17B) to match the curvature of the bottom surface of the adjustable sole portion 8010 and the leading surface portion 8024 of the sole 8022.

In the illustrated embodiment, both the leading edge surface 8024 and the bottom surface 8012 of the adjustable sole portion 8010 are convex surfaces. In other embodiments, surfaces 8012 and 8024 are not necessarily curved surfaces but they desirably still have the same profile extending in the heel-to-toe direction. In this manner, if the club head 8000 deviates from the grounded address position (e.g., the club is held at a lower or flatter lie angle), the effective face angle of the club head does not change substantially, as further described below. The crown-to-face transition or top-line would stay relatively stable when viewed from the address position as the club is adjusted between the lie ranges described herein. Therefore, the golfer is better able to align the club with the desired direction of the target line.

Figure 13D:
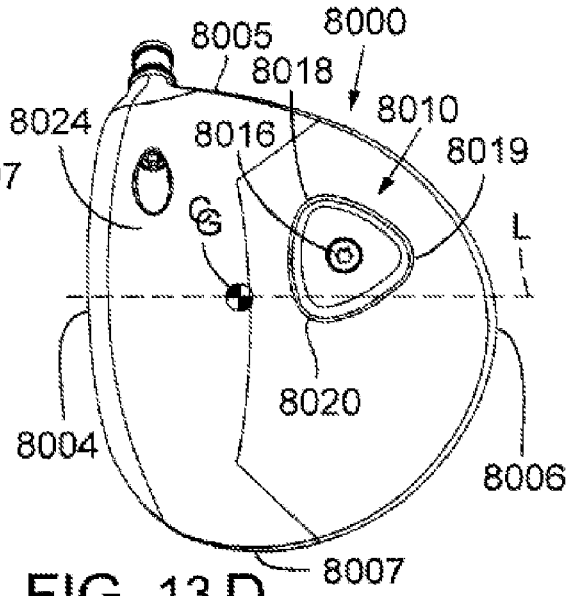
FIG. 13D is a bottom view of the golf club head of FIG. 13A.
Figure 13E:
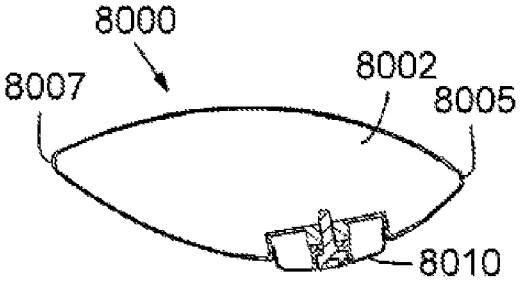
FIG. 13E is a cross-sectional view of the golf club head of FIG. 13B, taken along line 13E-13E.
Figure 13F:
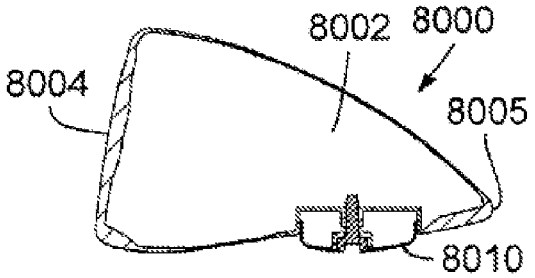
FIG. 13F is a cross-sectional view of the golf club head of FIG. 13C, taken along line 13F-13F.

In the embodiment shown in FIG. 13D, the triangular sole portion 8010 has a first corner 8018 located toward the heel 8005 of the club head and a second corner 8020 located near the middle of the sole 8022. A third corner 8019 is located rearward of the screw 8016. In this manner, the adjustable sole portion 8010 can have a length (from corner 8018 to corner 8020) that extends heel-to-toe across the club head less than half the width of the club head at that location of the club head. The adjustable sole portion 8010 is desirably positioned substantially heelward of a line L (see FIG. 13D) that extends rearward from the center of the striking face 8004 such that a majority of the sole portion is located heelward of the line L. Studies have shown that most golfers address the ball with a lie angle between 10 and 20 degrees less than the intended scoreline lie angle of the club head (the lie angle when the club head is in the address position). The length, size, and position of the sole portion 8010 in the illustrated embodiment is selected to support the club head on the ground at the grounded address position or any lie angle between 0 and 20 degrees less than the lie angle at the grounded address position while minimizing the overall size of the sole portion (and therefore, the added mass to the club head). In alternative embodiments, the sole portion 8010 can have a length that is longer or shorter than that of the illustrated embodiment to support the club head at a greater or smaller range of lie angles. For example, in some embodiments, the sole portion 8010 can extend past the middle of the sole 8022 to support the club head at lie angles that are greater than the scoreline lie angle (the lie angle at the grounded address position).

The adjustable sole portion 8010 is furthermore desirably positioned entirely rearward of the center of gravity (CG) of the golf club head, as shown in FIG. 13D. In some embodiments, the golf club head has an adjustable sole portion and a CG with a head origin x-axis (CGx) coordinate between about −10 mm and about 10 mm and a head origin y-axis (CGy) coordinate greater than about 10 mm or less than about 50 mm. In certain embodiments, the club head has a CG with an origin x-axis coordinate between about −5 mm and about 5 mm, an origin y-axis coordinate greater than about 0 mm and an origin z-axis ($CG_z$) coordinate less than about 0 mm. In one embodiment, the $CG_z$ is less than 2 mm.

The CGy coordinate is located between the leading edge surface portion 8024 that contacts the ground surface and the point where the bottom wall 8012 of the adjustable sole portion 8010 contacts the ground surface (as measured along the head origin—y-axis).

The sole angle of the club head 8000 can be adjusted by changing the distance the adjustable sole portion 8010 extends from the bottom of the body 8002. Adjusting the adjustable sole portion 8010 downwardly increases the sole angle of the club head 8000 while adjusting the sole portion upwardly decreases the sole angle of the club head. This can be done by loosening or removing the screw 8016 and rotating the adjustable sole portion 8010 such that a different pair of wall sections 8041 aligns with the projections 8058, then re-tightening the screw. In a triangular embodiment, the adjustable sole portion 8010 can be rotated to three different discrete positions, with each position aligning a different height pair of wall sections 8041 with the projections 8058. In this manner, the sole portion 8010 can be adjusted to extend three different distances from the bottom of the body 8002, thus creating three different sole angle options.

In particular, the sole portion 8010 extends the shortest distance from the sole 8022 when the projections 8058 are aligned with wall sections 8041*a*, 8041*b*; the sole portion 8010 extends an intermediate distance when the projections are aligned with wall sections 8041*c*, 8041*d*; and the sole portion extends the farthest distance when the projections 8058 are aligned with wall sections 8041*e*, 8041*f* Similarly, in an embodiment of the adjustable sole portion 8010 having a square shape, it is possible to have four different sole angle options.

In alternative embodiments, the adjustable sole portion 8010 can include more than or fewer than three pairs of wall sections 8041 that enable the adjustable sole portion to be adjusted to extend more than or fewer than three different discrete distances from the bottom of body 8002.

The sole portion 8010 can be adjusted to extend different distances from the bottom of the body 8002, as discussed above, which in turn causes a change in the face angle 30 of the club. In particular, adjusting the sole portion 8010 such that it extends the shortest distance from the bottom of the body 8002 (e.g., the projections 8058 are aligned with sections 8041*a* and 8041*b*) can result in an increased face angle or open the face and adjusting the sole portion such that it extends the farthest distance from the bottom of the body (e.g., the projections are aligned with sections 8041*e* and 8041*f*) can result in a decreased face angle or close the face. In particular embodiments, adjusting the sole portion 8010 can change the face angle of the golf club head 8000 about 0.5 to about 12 degrees. Also, the hosel loft angle can also be adjusted to achieve various combinations of square loft, grounded loft, face angle and hosel loft. Additionally, hosel loft can be adjusted while maintaining a desired face angle by adjusting the sole angle accordingly.

It can be appreciated that the non-circular shape of the sole portion 8010 and the recessed cavity 8014 serves to help prevent rotation of the sole portion relative to the recessed cavity and defines the predetermined positions for the sole portion. However, the adjustable sole portion 8010 could have a circular shape (not shown). To prevent a circular outer rim 8034 from rotating within a cavity, one or more notches can be provided on the outer rim 8034 that interact with one or more tabs extending inward from the cavity side wall 8050, or vice versa. In such circular embodiments, the sole portion 8010 can include any number of pairs of wall sections 8041 having different heights. Sufficient notches on the outer rim 8034 can be provided to correspond to each of the different rotational positions that the wall sections 8041 allow for.

In other embodiments having a circular sole portion 8010, the sole portion can be rotated within a cavity in the club head to an infinite number of positions. In one such embodiment, the outer rim of the sole portion and the cavity side wall 8050 can be without notches and the circular wall 8040 can comprise one or more gradually inclining ramp-like wall sections (not shown). The ramp-like wall sections can allow the sole portion 8010 to gradually extend farther from the bottom of the body 8002 as the sole portion is gradually rotated in the direction of the incline such that projections 8058 contact gradually higher portions of the ramp-like wall sections. For example, two ramp-like wall sections, each extending about 180-degrees around the circular wall 8040, can be included, such that the shortest portion of each ramp-like wall section is adjacent to the tallest portion of the other wall section. In such an embodiment having an "analog" adjustability, the club head can rely on friction from the screw 8016 or other central fastener to prevent the sole portion 8010 from rotating within the recessed cavity 8014 once the position of the sole portion is set.

The adjustable sole portion 8010 can also be removed and replaced with an adjustable sole portion having shorter or taller wall sections 8041 to further add to the adjustability of the sole angle of the club 8000. For example, one triangular sole portion 8010 can include three different but relatively shorter pairs of wall sections 8014, while a second sole portion can include three different but relatively longer pairs of wall sections. In this manner, six different sole angles 2018 can be achieved using the two interchangeable triangular sole portions 8010. In particular embodiments, a set of a plurality of sole portions 8010 can be provided. Each sole portion 8010 is adapted to be used with a club head and has differently configured wall sections 8041 to achieve any number of different sole angles and/or face angles.

In particular embodiments, the combined mass of the screw 8016 and the adjustable sole portion 8010 is between about 2 and about 11 grams, and desirably between about 4.1 and about 4.9 grams. Furthermore, the recessed cavity 8014 and the projection 8054 can add about 1 to about 10 grams of additional mass to the sole 8022 compared to if the sole had a smooth, 0.6 mm thick, titanium wall in the place of the recessed cavity 8014. In total, the golf club head 8000 (including the sole portion 8010) can comprise about 3 to about 21 grams of additional mass compared to if the golf club head had a conventional sole having a smooth, 0.6 mm thick, titanium wall in the place of the recessed cavity 8014, the adjustable sole portion 8010, and the screw 8016.

A club shaft is received within the hosel bore 124 and, in some embodiments, may be aligned with the centerline axis 121. In some embodiments, a connection assembly is provided that allows the shaft to be easily disconnected from the club head 100. In still other embodiments, the connection assembly provides the ability for the user to selectively adjust the loft-angle 115 and/or lie-angle 119 of the golf club. For example, in some embodiments, a sleeve is mounted on a lower end portion of the shaft and is configured to be inserted into the hosel bore 124. The sleeve has an upper portion defining an upper opening that receives the lower end portion of the shaft, and a lower portion having a plurality of longitudinally extending, angularly spaced external splines located below the shaft and adapted to mate with complimentary splines in the hosel opening 124. The lower portion of the sleeve defines a longitudinally extending, internally threaded opening adapted to receive a screw for securing the shaft assembly to the club head 100 when the sleeve is inserted into the hosel opening 124. Further detail concerning the shaft connection assembly is provided in U.S. Patent Application Publication No. 2010/0197424, which is incorporated herein by reference.

Figure 18:
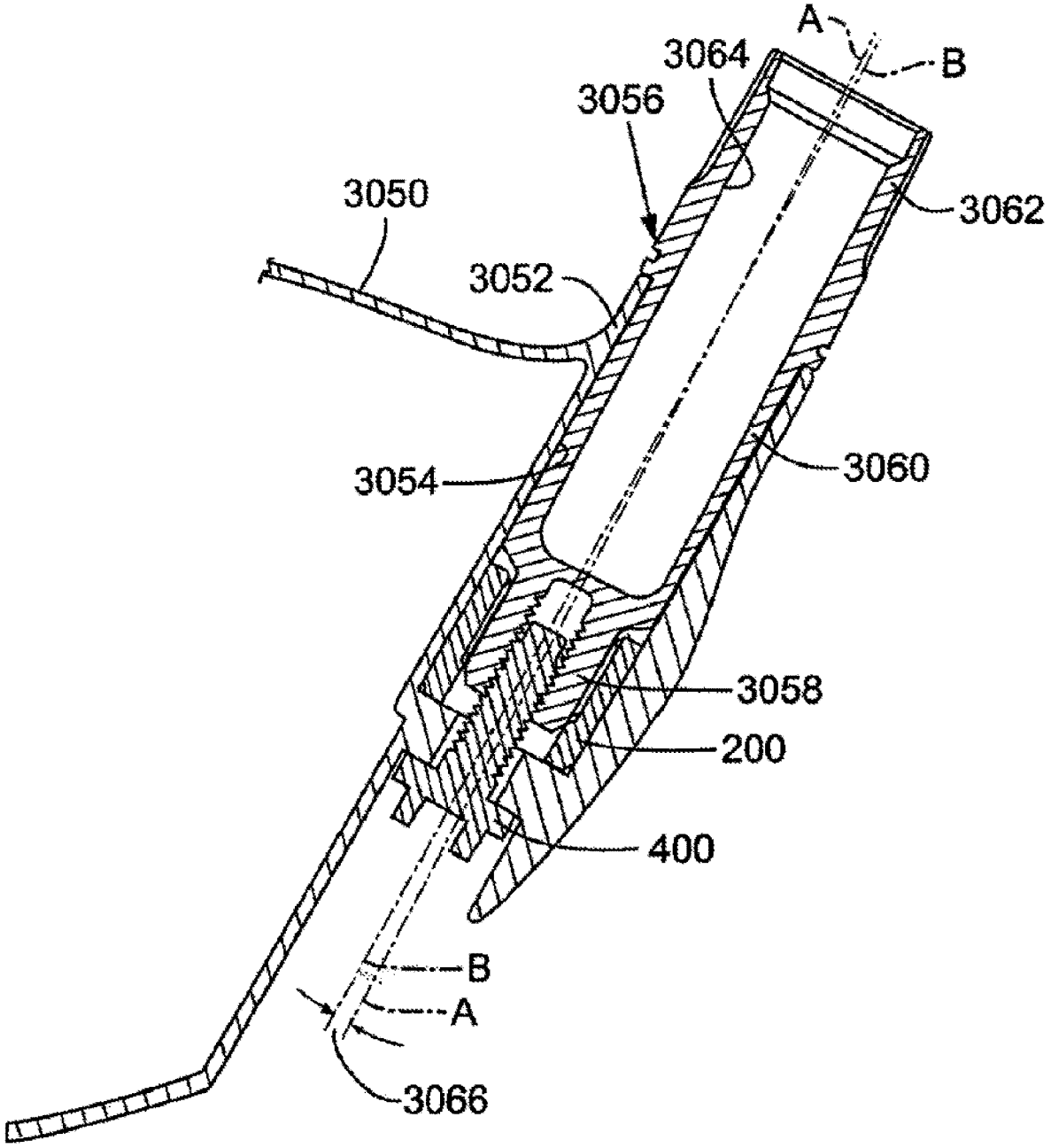
FIG. 18 is an enlarged cross-sectional view of a golf club head having a removable shaft, in accordance with another embodiment.

For example, FIG. 18 shows an embodiment of a golf club assembly that includes a club head 3050 having a hosel 3052 defining a hosel opening 3054, which in turn is adapted to receive a hosel insert 200. The hosel opening 3054 is also adapted to receive a shaft sleeve 3056 mounted on the lower end portion of a shaft (not shown in FIG. 18) as described in U.S. Patent Application Publication No. 2010/0197424. The hosel opening 3054 extends from the hosel 3052 through the club head and opens at the sole, or bottom surface, of the club head. Generally, the club head is removably attached to the shaft by the sleeve 3056 (which is mounted to the lower end portion of the shaft) by inserting the sleeve 3056 into the hosel opening 3054 and the hosel insert 200 (which is mounted inside the hosel opening 3054), and inserting a screw 400 upwardly through an opening in the sole and tightening the screw into a threaded opening of the sleeve, thereby securing the club head to the sleeve 3056.

The shaft sleeve 3056 has a lower portion 3058 including splines that mate with mating splines of the hosel insert 200, an intermediate portion 3060 and an upper head portion 3062. The intermediate portion 3060 and the head portion 3062 define an internal bore 3064 for receiving the tip end portion of the shaft. In the illustrated embodiment, the intermediate portion 3060 of the shaft sleeve has a cylindrical external surface that is concentric with the inner cylindrical surface of the hosel opening 3054. In this manner, the lower and intermediate portions 3058, 3060 of the shaft sleeve and the hosel opening 3054 define a longitudinal axis B. The bore 3064 in the shaft sleeve defines a longitudinal axis A to support the shaft along axis A, which is offset from axis B by a predetermined angle 3066 determined by the bore 3064. As described in more detail in U.S. Patent Application Publication No. 2010/0197424, inserting the shaft sleeve 3056 at different angular positions relative to the hosel insert 200 is effective to adjust the shaft loft and/or the lie angle.

Figure 19:
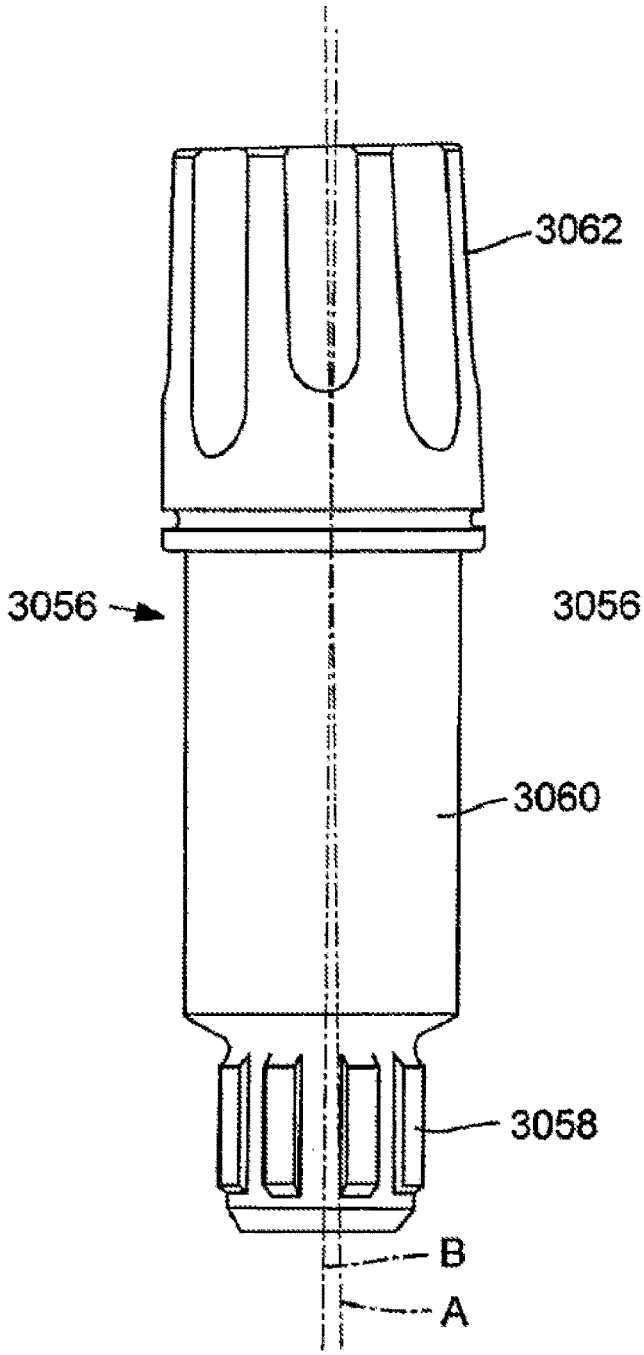
FIGS. 19 and 20 are front elevation and cross-sectional views, respectively, of a shaft sleeve of the assembly shown in FIG. 18.
Figure 20:
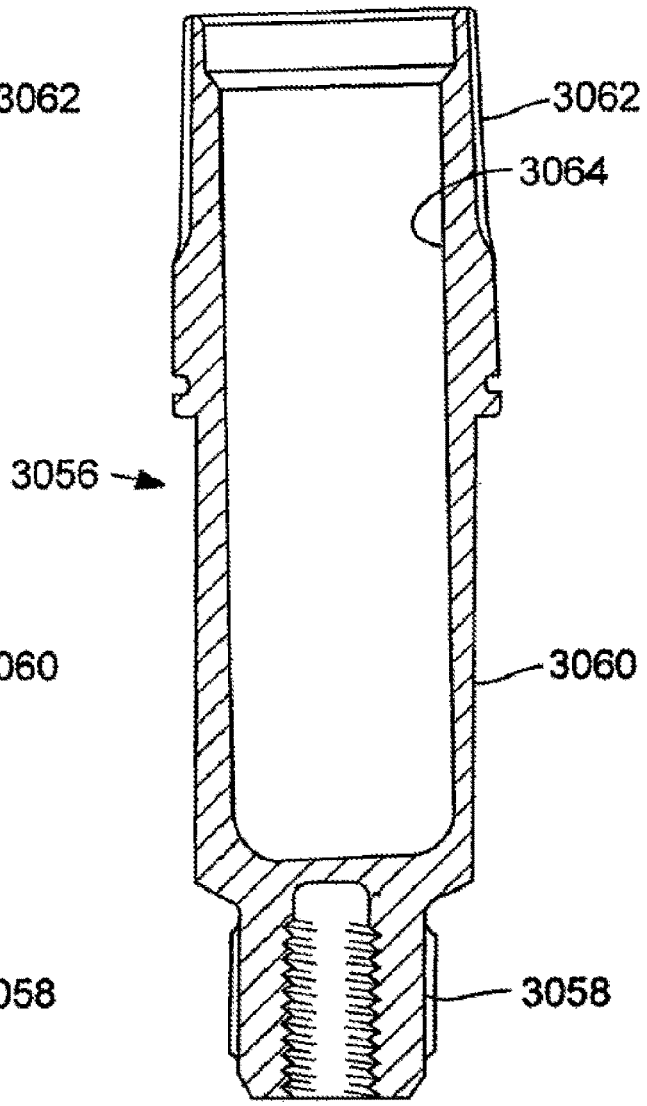

In the embodiment shown, because the intermediate portion 3060 is concentric with the hosel opening 3054, the outer surface of the intermediate portion 3060 can contact the adjacent surface of the hosel opening, as depicted in FIG. 18. This allows easier alignment of the mating features of the assembly during installation of the shaft and further improves the manufacturing process and efficiency. FIGS. 19 and 20 are enlarged views of the shaft sleeve 3056. As shown, the head portion 3062 of the shaft sleeve (which extends above the hosel 3052) can be angled relative to the intermediate portion 3060 by the angle 3066 so that the shaft and the head portion 3062 are both aligned along axis A. In alternative embodiments, the head portion 3062 can be aligned along axis B so that it is parallel to the intermediate portion 3060 and the lower portion 3058.

H. Club Head Volume and Mass

Embodiments of the disclosed golf club heads disclosed herein can have a variety of different volumes. For example, certain embodiments of the disclosed golf club heads are for drivers and have a club head volume of between 250 and 460 $cm^3$ and a club head mass of between 180 and 210 grams. Other embodiments of the disclosed golf club heads have a volume larger than 460 $cm^3$ and/or have a mass of greater than 210 g. If such a club head is desired, it can be constructed as described above by enlarging the size of the strike plate and the outer shell of the golf club head.

II. Golf Club Head Crown Construction

Discretionary mass generally refers to the mass of material that can be removed from various structures providing mass. In some cases, the mass is removed for the purpose of reducing overall club mass to allow for higher club head speeds. In other cases, the removed mass can be distributed elsewhere to other structures within the golf club head to achieve desired mass properties, or to allow for the addition of adjustability features which typically add mass to the club head.

Club head walls provide one source of discretionary mass. A reduction in wall thickness reduces the wall mass and provides mass that can be distributed elsewhere. For example, in some current golf club heads, one or more walls of the club head can have a thickness less than approximately 0.7 mm. In some examples, the crown 112 can have a thickness of approximately 0.65 mm throughout at least a majority of the crown. In addition, the skirt 116 can have a similar thickness, whereas the sole 114 can have a greater thickness (e.g., more than approximately 1.0 mm). Thin walls, particularly a thin crown 112, provide significant discretionary mass. To achieve a thin wall on the club head body 110, such as a thin crown 112, club head bodies 110 have been formed from alloys of steel, titanium, aluminum, or other metallic materials. In other examples, the thin walls of the club head body are formed of a non-metallic material, such as a composite material, ceramic material, thermoplastic, or any combination thereof.

Club head durability and manufacturability (e.g., ability to cast thin walls) present limits on the ability of club head designers and club head manufacturers to achieve mass savings from the use of thin wall construction for the crown portion 112 of golf club heads. Several embodiments of club head crown construction described herein are able to achieve such savings while maintaining suitable durability and manufacturability.

Turning to FIGS. 7A-B, 8A-B, and 9, several embodiments of golf club head crown portions are shown. Each of the illustrated embodiments includes a club head crown having a lattice-like structure having thin regions that are surrounded by and strengthened by a web of relatively thicker regions. The resulting crown designs provide mass savings for the club head while maintaining suitable durability and manufacturability.

Figure 7A:
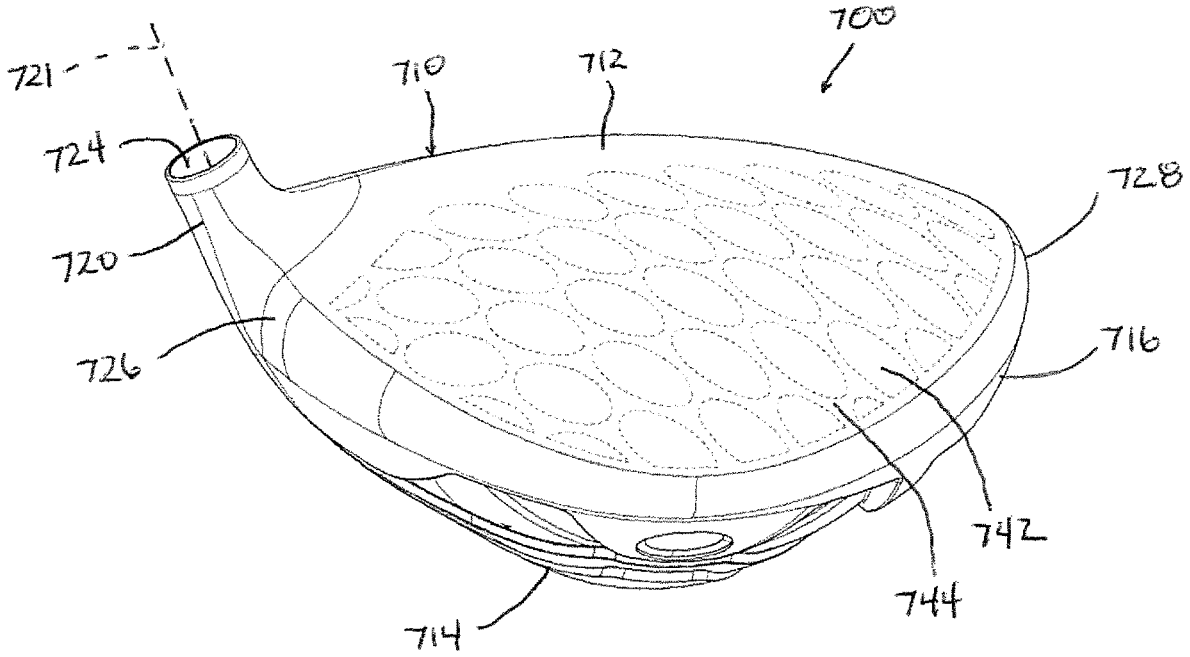
FIGS. 7A-B are rear elevation and top plan views, respectively, of an exemplary embodiment of a golf club head showing (in dashed lines) a lattice-like structure formed on the interior surface of the crown.
Figure 7B:
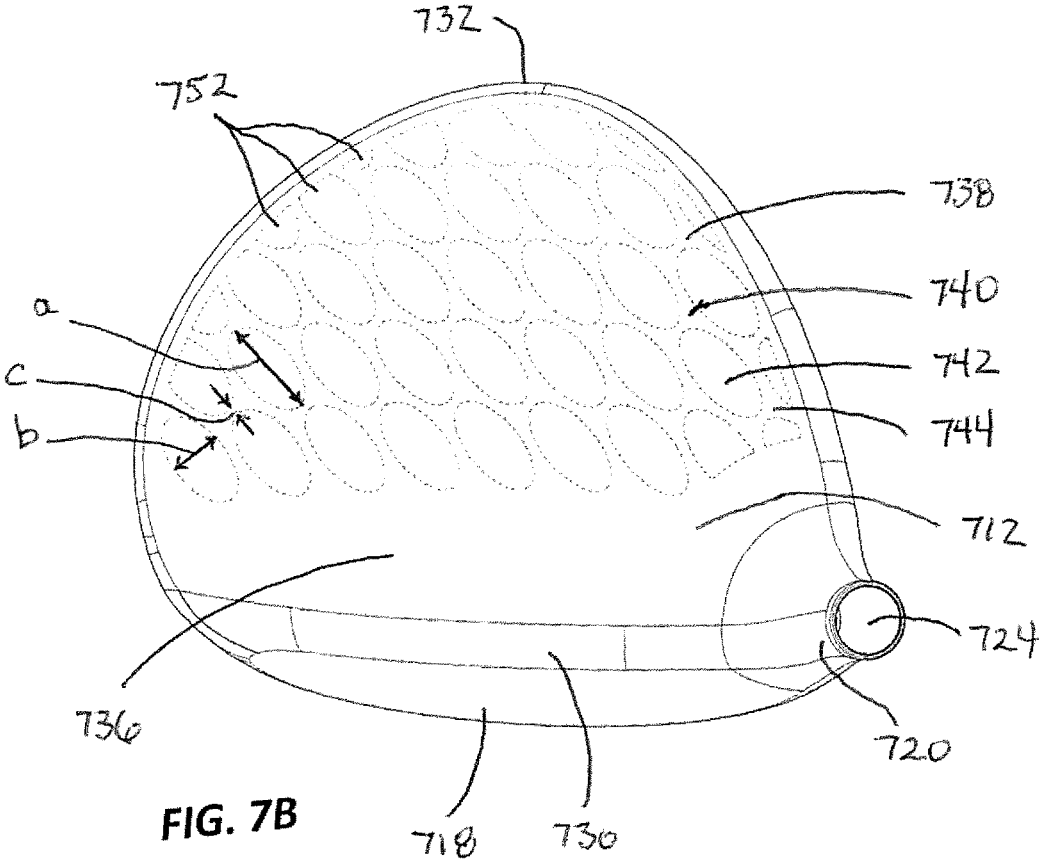

For example, FIGS. 7A-B show a golf club head 700 including a hollow body 710 defining a crown portion 712, a sole portion 714, a skirt portion 716, and a ball striking club face 718. The body 710 further includes a hosel 720, which defines a hosel bore 724 adapted to receive a golf club shaft. The body 710 further includes a heel portion 726, a toe portion 728, a front portion 730, and a rear portion 732. The body 710 is preferably formed of a titanium alloy. In other embodiments, the body 710 is formed of other materials, such as a steel alloy, an aluminum alloy, a composite material, or another of the materials described herein.

The crown 712 of the illustrated embodiment includes a forward crown portion 736 and a rearward crown portion 738. The rearward crown portion 738 is defined by the presence of a lattice-like structure 740 that includes a plurality of thin regions 742 that are surrounded by a web of relatively thicker regions 744. The forward crown portion 736 extends between the striking face 718 at the front portion 730 of the club head and the rearward crown portion 738 toward the rear portion 732 of the club head. The rearward crown portion 738 extends between the forward crown portion 736 and the rear portion 732 of the club head. In the embodiment shown, each of the forward crown portion 736 and the rearward crown portion 738 extends substantially over the full width of the crown 712 from the heel portion 726 to the toe portion 728. In alternative embodiments, either or both of the forward crown portion 736 and rearward crown portion 738 may extend over only a portion of the full toe-to-heel width of the crown 712.

In the embodiment shown in FIGS. 7A-B, the thin regions 742 of the lattice-like structure 740 each have an elliptical shape defining a major axis "a" and a minor axis "b". In these embodiments, the length of the major axis "a" is from about 12 mm to about 26 mm, such as from about 15 mm to about 23 mm, or about 17 mm to about 21 mm, and the length of the minor axis "b" is from about 3 mm to about 13 mm, such as from about 5 mm to about 11 mm, or from about 6.5 mm to about 9.5 mm. Alternative embodiments include thin regions 742 having larger elliptical shapes, smaller elliptical shapes, or shapes other than elliptical. For example, in some embodiments, the thin regions 742 have a rectangular, oval, or other regular or irregular elongated shape having a length dimension and a width dimension, with the length dimension being from about 12 mm to about 26 mm, such as from about 15 mm to about 23 mm, or about 17 mm to about 21 mm, and the width dimension being from about 3 mm to about 13 mm, such as from about 5 mm to about 11 mm, or from about 6.5 mm to about 9.5 mm.

In the embodiment shown, at least a portion of the thin regions 742—and preferably all of the thin regions 742—are arranged such that the major axes "a" of substantially all of the thin regions 742 are generally aligned with or parallel to one another, and the minor axes "b" of substantially all of the thin regions 742 are generally aligned with or parallel to one another. The resulting matrix of thin regions 742 includes thin regions 742 that are aligned along their major axes "a" in a plurality of substantially parallel rows 752. Within each row 752, a first end of each thin region 742 is spaced from a second end of an adjacent thin region 742 by a substantially uniform minimum distance "c". Adjacent rows 752 of thin regions include thin regions 742 that are staggered relative to each other such that the minor axis "b" of each thin region 742 is substantially aligned with the thick region 744 extending between a pair of adjacent thin regions in the adjacent rows 752 on either side of the thin region 742. Moroever, the minor axis "b" of each thin region 742 is substantially nested within the spacing created by a pair of thin regions 742 in adjacent rows 752, such that the distance between adjacent rows 752 is less than the length of the minor axes "b" of the thin regions 742 included in the adjacent rows 752. As a result, the thick regions 744 define a non-linear path between adjacent rows 752 of thin regions.

The thin regions 742 in the embodiment shown in FIGS. 7A-B have a thickness of from about 0.3 mm to about 0.6 mm, such as from about 0.35 mm to about 0.5 mm, or about 0.4 mm. The thick regions 744 in the embodiment shown in FIGS. 7A-B have a thickness of from about 0.5 mm to about 0.8 mm, such as from about 0.55 mm to about 0.7 mm, or about 0.6 mm. There is a thickness differential between the thin regions and the thick regions in the lattice-like structure. In some embodiments, the thickness differential is at least 0.05 mm, such as at least 0.1 mm, such as at least 0.15 mm. The foregoing thicknesses refer to the components of the golf club head 710 after all manufacturing steps have been taken, including construction (e.g., casting, stamping, welding, brazing, etc.), finishing (e.g., polishing, etc.), and any other steps.

The forward crown portion 736 of the golf club head 710 may be constructed to have a relatively greater thickness than either the thin regions 742 or thick regions 744 of the lattice-like structure 740 in order to provide greater durability to the golf club head. For example, in some embodiments, the forward crown portion 736 has a thickness of from about 0.6 to about 1.0 mm, such as from about 0.7 to about 0.9 mm, or about 0.8 mm. In other embodiments, the forward crown portion 736 has a thickness that is substantially the same as the thickness of the thick regions 744 of the lattice-like structure 740.

As noted previously, the golf club head 700 may be constructed by techniques such as molding, cold forming, casting, and/or forging. Alternatively, any one or more of the crown 712, sole 714, skirt 716, or ball striking club face 718 can be attached to the other components by known means (e.g., adhesive bonding, welding, and the like). In one embodiment, the crown 712, sole 714, skirt 716, and hosel 720 are formed by a casting process, and the club face 718 is subsequently attached via welding in a separate process. In another embodiment, the crown 712 is formed separately from the other components of the golf club head 700, such as by stamping, forging, or casting, and the crown 712 is subsequently attached to the other components via welding in a separate process.

In some embodiments, the crown 712 is formed by initially casting the crown having a uniform thickness (e.g., no thin regions 742 or thick regions 744). Instead, a plurality of protrusions are formed extending on the external surface of the crown 712. The protrusions define a pattern corresponding with the thin regions 742 ultimately to be included on the internal surface of the crown 712. These protrusions are then removed from the exterior surface of the crown 712 via a polishing procedure to achieve a smooth external crown surface, leaving the lattice-like structure 740 formed on the interior surface of the crown 712.

Figure 8A:
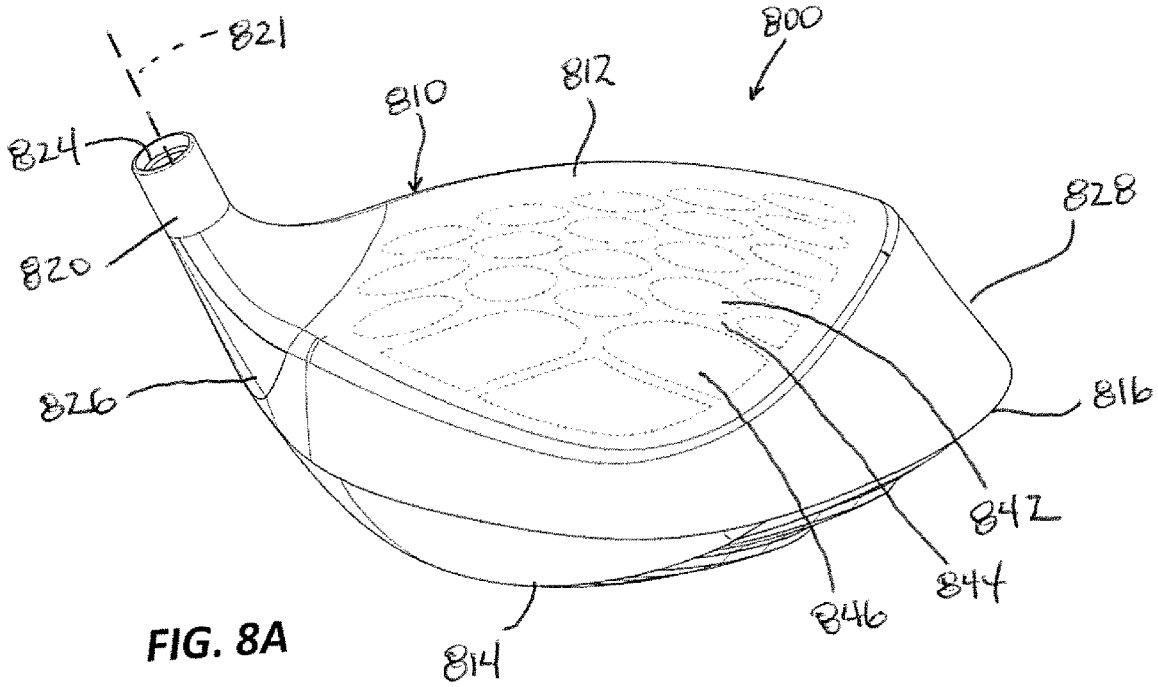
FIGS. 8A-B are rear elevation and top plan views, respectively, of another exemplary embodiment of a golf club head showing (in dashed lines) a lattice-like structure formed on the interior surface of the crown.
Figure 8B:
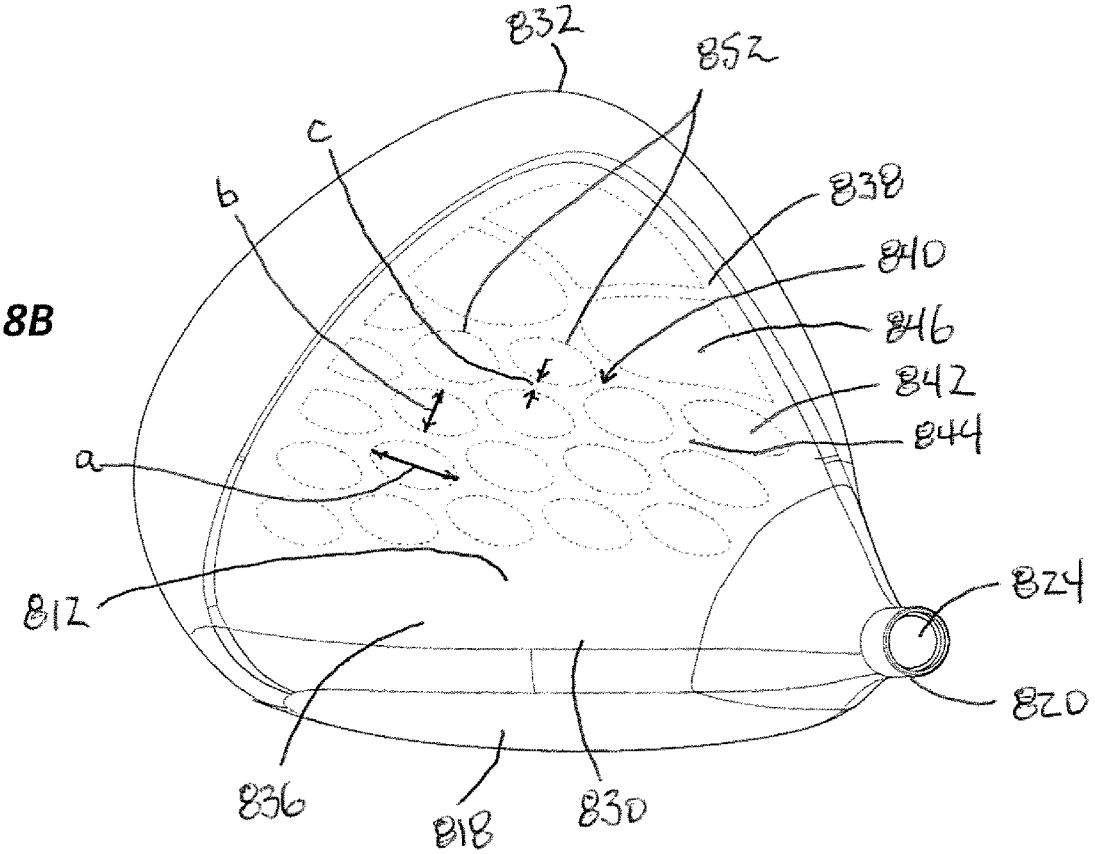

Turning next to FIGS. 8A-B, an alternative embodiment of a lattice-like structure 840 formed on the interior surface of a golf club head crown portion 812 is shown. A golf club head 800 includes a hollow body 810 defining a crown portion 812, a sole portion 814, a skirt portion 816, and a ball striking club face 818. The body 810 further includes a hosel 820, which defines a hosel bore 824 adapted to receive a golf club shaft. The body 810 further includes a heel portion 826, a toe portion 828, a front portion 830, and a rear portion 832. The body 810 is preferably formed of a titanium alloy. In other embodiments, the body 810 is formed of other materials, such as a steel alloy, an aluminum alloy, a composite material, or another of the materials described herein.

The crown 812 of the illustrated embodiment includes a forward crown portion 836 and a rearward crown portion 838. In the embodiment shown in FIGS. 8A-B, the lattice-like structure 840 includes a first plurality of thin regions 842 each having an elliptical shape defining a major axis "a" and a minor axis "b". In these embodiments, the length of the major axis "a" is from about 12 mm to about 26 mm, such as from about 15 mm to about 23 mm, or about 17 mm to about 21 mm, and the length of the minor axis "b" is from about 3 mm to about 13 mm, such as from about 5 mm to about 11 mm, or from about 6.5 mm to about 9.5 mm. Alternative embodiments include thin regions 842 having larger elliptical shapes, smaller elliptical shapes, or shapes other than elliptical.

The embodiment shown in FIGS. 8A-B also includes a second plurality of thin regions 846 occupying the rearward-most portion of the crown 812. Each of the second plurality of thin regions 846 is larger (in surface area) than each of the first plurality of thin regions 842. In the embodiment shown, each of the second plurality of thin regions 846 is non-elliptical in shape.

In the embodiment shown, at least a portion of the first plurality of thin regions 842—and preferably all of the first plurality of thin regions 842—are arranged such that the major axes "a" of substantially all of the thin regions 842 are generally aligned with or parallel to one another, and the minor axes "b" of substantially all of the thin regions 842 are generally aligned with or parallel to one another. The resulting matrix of thin regions 842 includes thin regions 842 that are aligned along their minor axes "b" in a plurality of substantially parallel rows 852. Within each row 852, a first side of each thin region 842 is spaced from a second side of an adjacent thin region 842 by a substantially uniform minimum distance "c". Adjacent rows 852 of thin regions include thin regions 842 that are staggered relative to each other such that the major axis "a" of each thin region 842 is substantially aligned with the thick region 844 extending between a pair of adjacent thin regions in the adjacent rows 852 on either side of the thin region 842. Moreover, the major axis "a" of each thin region 842 is substantially nested within the spacing created by a pair of thin regions 842 in adjacent rows 852, such that the distance between adjacent rows 852 is less than the length of the major axes "a" of the thin regions 842 included in the adjacent rows 852. As a result, the thick regions 844 define a non-linear path between adjacent rows 852 of thin regions.

The thin regions 842 and 846 in the embodiment shown in FIGS. 8A-B have a thickness of from about 0.3 mm to about 0.6 mm, such as from about 0.35 mm to about 0.5 mm, or about 0.4 mm. The thick regions 844 in the embodiment shown in FIGS. 7A-B have a thickness of from about 0.5 mm to about 0.8 mm, such as from about 0.55 mm to about 0.7 mm, or about 0.6 mm. There is a thickness differential between the thin regions and the thick regions in the lattice-like structure. In some embodiments, the thickness differential is at least 0.05 mm, such as at least 0.1 mm, such as at least 0.15 mm. The foregoing thicknesses refer to the components of the golf club head 810 after all manufacturing steps have been taken, including construction (e.g., casting, stamping, welding, brazing, etc.), finishing (e.g., polishing, etc.), and any other steps.

The forward crown portion 836 of the golf club head 810 may be constructed to have a relatively greater thickness than either the thin regions 842, 846 or thick regions 844 of the lattice-like structure 840 in order to provide greater durability to the golf club head. For example, in some embodiments, the forward crown portion 836 has a thickness of from about 0.6 to about 1.0 mm, such as from about 0.7 to about 0.9 mm, or about 0.8 mm. In other embodiments, the forward crown portion 836 has a thickness that is substantially the same as the thickness of the thick regions 844 of the lattice-like structure 840.

Figure 9:
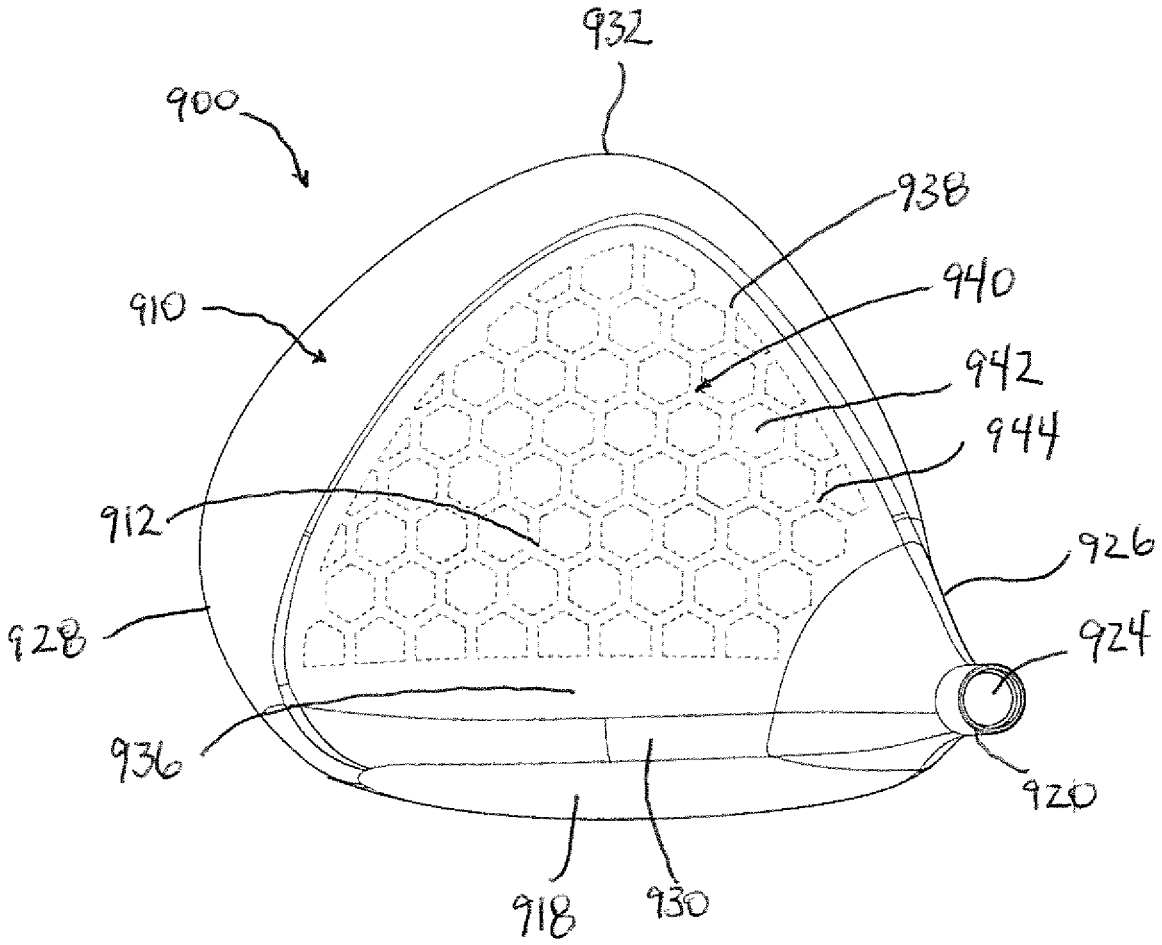
FIG. 9 is a top plan view of still another exemplary embodiment of a golf club head showing (in dashed lines) a lattice-like structure formed on the interior surface of the crown.

In FIG. 9, another alternative embodiment of a lattice-like structure 940 formed on the interior surface of a golf club head crown portion 912 is shown. In the illustrated embodiment, the lattice-like structure 940 in the rearward crown portion 938 includes a plurality of hexagonally-shaped thin regions 942 that are surrounded by a web of relatively thicker regions 944.

Depending upon the volume of the golf club head and the materials used in the crown portion, mass savings achieved by the foregoing crown portion designs may be greater than about 2 g, such as greater than about 4 g, or greater than about 6 g. The mass savings are in comparison to a crown having a constant thickness that is substantially the same as the thick regions of the lattice-like structures of the golf club head crown portions described above in relation to FIGS. 7A-B, 8A-B, and 9. In addition, durability testing was conducted by comparing the durability of golf club heads having a constant thickness crown (corresponding to the thickness of the thicker web regions 744) to golf club heads having a crown with a lattice-like structure such as the embodiments shown in and described with reference to FIGS. 7A-B above. The inventive golf club heads were found to have durability that was well within an acceptable range for normal use.

Exemplary golf club heads were constructed having a crown portion 712 that included the lattice-like structure shown in FIGS. 7A-B. The exemplary golf club heads are described by reference to the information included in Table 1:

TABLE 1

| | Example 1 | Example 2 | Example 3 |
|---|---|---|---|
| Body material | SS | Ti alloy | Ti alloy |
| Thin region thickness | 0.45 mm | 0.5 mm | 0.5 mm |
| Thick region thickness | 0.6 mm | 0.6 mm | 0.6 mm |
| Thin region surface area (internal crown surface) | 3470 $mm^2$ | 4208 $mm^2$ | 5318 $mm^2$ |
| Crown surface area (external crown surface) | 7081 $mm^2$ | 9661 $mm^2$ | 11790 $mm^2$ |

TABLE 1-continued

| | Example 1 | Example 2 | Example 3 |
|---|---|---|---|
| Ratio of thin region surface area (internal) to crown surface area (external) | 0.49 | 0.44 | 0.45 |
| Mass savings from thin regions | 4.1 gm | 1.9 gm | 2.4 gm |

The "thin region surface area" data presented in Table 1 represents the cumulative surface area of the thin regions 742 on the internal surface of the crown 712 of each of the exemplary golf club heads. The "crown surface area" data represents the total surface area of the external surface of the crown 712. The "mass savings from thin regions" is the mass of the material that is effectively "removed" from the crown by the provision of the thin regions 742. The "mass savings" is determined by multiplying the cumulative thin region surface area by the depth of the thin regions to obtain a cumulative thin region "volume," which is then multiplied by the crown material density to obtain a mass savings.

The data in Table 1 shows that the inventive golf club heads described herein include a very large portion of the crown 712 that is occupied by thin regions of a lattice-like structure. More particularly, the inventive golf club heads achieve a ratio of thin region internal surface area to crown external surface area of between 0.40 to 0.55, such as between 0.40 to 0.50, such as between 0.44 to 0.50.

III. Golf Club Head Stiffening Members

Thin walled golf club heads, particularly wood-type golf club heads, can produce an undesirably low frequency sound (e.g., less than about 3,000 Hz) when striking a golf ball. In order to stiffen the club head structure, and to thereby increase the frequency of the sound vibrations produced by the golf club head, one or more stiffening members (e.g., stiffening tubes) may be attached (e.g., via welding) to the interior of the body of the club head.

Described below are several embodiments of golf club heads having one or more stiffening members mounted within an interior cavity of the club head. The one or more stiffening members can be positioned anywhere within the interior cavity. In particular embodiments, the golf club head has an unsupported area, e.g., a pocket, depression, or concave portion, on an external portion of the club head. In specific implementations, the one or more stiffening members connect with and/or extend at least partially along or within the unsupported area to improve properties, such as acoustical characteristics, of the golf club head upon impacting a golf ball.

Figure 10A:
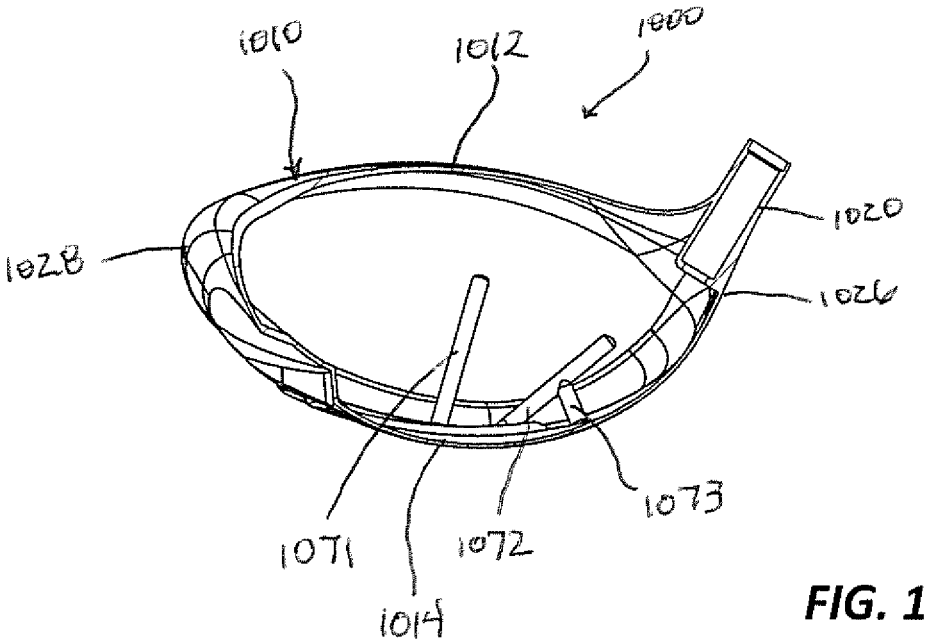
FIG. 10A is a front view of an exemplary embodiment of a golf club head with a forward portion of the club head removed for clarity.
Figure 10B:
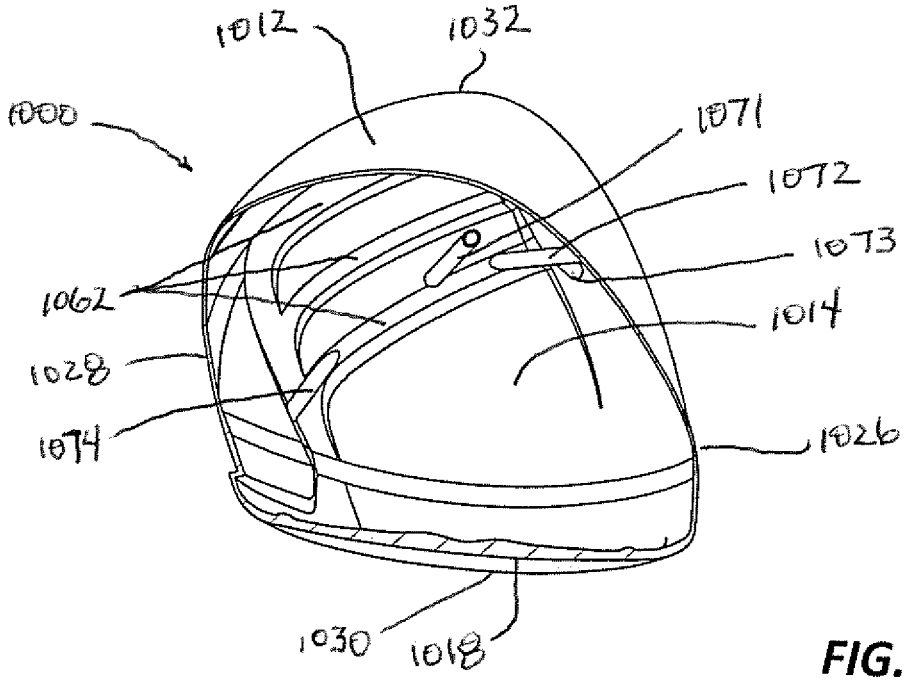
FIG. 10B is a top view of the golf club head embodiment shown in FIG. 10A with a portion of the crown removed for clarity.

Referring to FIGS. 10A-B, and according to one particular embodiment, a wood-type golf club head 1000 is shown. The golf club head 1000 includes a hollow body 1010 defining a crown portion 1012, a sole portion 1014, a skirt portion 1016, and a ball striking club face 1018. The ball striking club face 1018 can be integrally formed with the body 1010 or attached to the body. The body 1010 further includes a hosel 1020, which defines a hosel bore 1024 adapted to receive a golf club shaft. The body 1010 further includes a heel portion 1026, a toe portion 1028, a front portion 1030, and a rear portion 1032.

The crown 1012, sole 1014, and skirt 1016 can have any of various shapes and contours. In the specific embodiment shown in FIGS. 10A-B, the crown 1012 and skirt 1016 have generally rounded, convex profiles. The sole 1014 is generally convex in shape, but includes a plurality of steps 1062 that create localized concave portions within the interior cavity of the club head 1000. As used herein, a convex portion is defined as a portion of the golf club head body having an external surface that curves, bulges, or otherwise projects generally outward away from the interior portion of the body. Likewise, a concave portion can be defined as a portion of the golf club head body having an external surface that curves, bulges or otherwise projects generally inward toward the interior portion of the body.

In some embodiments, the club head body 1010 is thin-walled. For example, the crown portion 1012 and skirt portion 1016 each may have an average thickness of from about 0.6 mm to about 1.0 mm, such as from about 0.65 mm to about 0.9 mm, or about 0.7 mm to about 0.8 mm. The sole portion 1014 may have an average thickness of from about 0.8 mm to about 1.8 mm, such as from about 1.0 mm to about 1.6 mm, or about 1.0 mm to about 1.4 mm. In the embodiment shown in FIGS. 10A-B, the club head body 1010 is constructed by forming at least the crown portion 1012, sole portion 1014, and club face 1018 as separate components that are welded or brazed together. The crown portion 1012 and sole portion 1014 may be formed by casting, stamping, forging, or other processes known to those skilled in the art. In other, alternative embodiments, the club head body 1010 is constructed by casting at least the crown portion 1012, sole portion 1014, and skirt portion 1016 together and subsequently attaching a club striking face 1018 via a welding or adhesive process.

The golf club head 1000 includes one or more stiffening members, such as stiffening tubes 1071, 1072, 1073, 1074. As used herein, a stiffening member is defined generally as a structure having any of various shapes and sizes projecting or extending from any portion of the golf club head to provide structural support to, improved performance of, and/or acoustical enhancement of the golf club head. Stiffening members can be co-formed with, coupled to, secured to, or attached to, the golf club head. In more specific implementations, a stiffening tube includes a tubular, thin-walled structure which may be solid or may be hollow. In other embodiments, the stiffening tube has a conical, I-beam, or other cross-sectional shape that promotes stiffness. The stiffening tubes may be formed of a metallic alloy (e.g., titanium alloy, aluminum alloy, steel alloy), a polymer-fiber composite material, or other material providing an appropriate combination of stiffness and light weight.

In the illustrated embodiment, the stiffening tubes 1071, 1072, 1073, and 1074 comprise tubes formed of a titanium alloy and having an outer diameter of from about 2 mm to about 7 mm, such as from about 3 mm to about 6 mm, or about 4 mm to about 5 mm. The illustrated stiffening tubes 1071, 1072, 1073, and 1074 have a wall thickness of from about 0.25 mm to about 2.5 mm, such as from about 0.3 mm to about 1.5 mm, or from about 0.4 mm to about 1.0 mm, or about 0.5 mm.

In the embodiment shown in FIGS. 10A-B, a first stiffening tube 1071 and a second stiffening tube 1072 each extend between and are attached to each of the sole 1014 and the crown 1012. The first stiffening tube 1071 is attached to the sole 1014 adjacent to a step 1062 formed in the sole. The first stiffening tube 1071 extends generally upward from the sole 1014 at a slight angle away from vertical toward the heel side 1026 of the club head. The second stiffening tube 1072 is attached to the sole 1014 at the step 1062 and toward the heel side 1026 relative to the first stiffening tube 1071. The second stiffening tube 1072 extends generally upward from the sole 1014 at a larger angle away from vertical toward the heel side 1026 of the golf club head relative to the angle of the first stiffening tube 1071. A third stiffening tube 1073 is attached at a first end to the sole 1014 and at a second end to the second stiffening tube 1072 near its midpoint. A fourth stiffening tube 1074 is attached at a first end to the step 1062 formed on the sole 1014 and near the toe portion 1028, and at a second end to the skirt at the toe portion 1028.

Figure 11A:
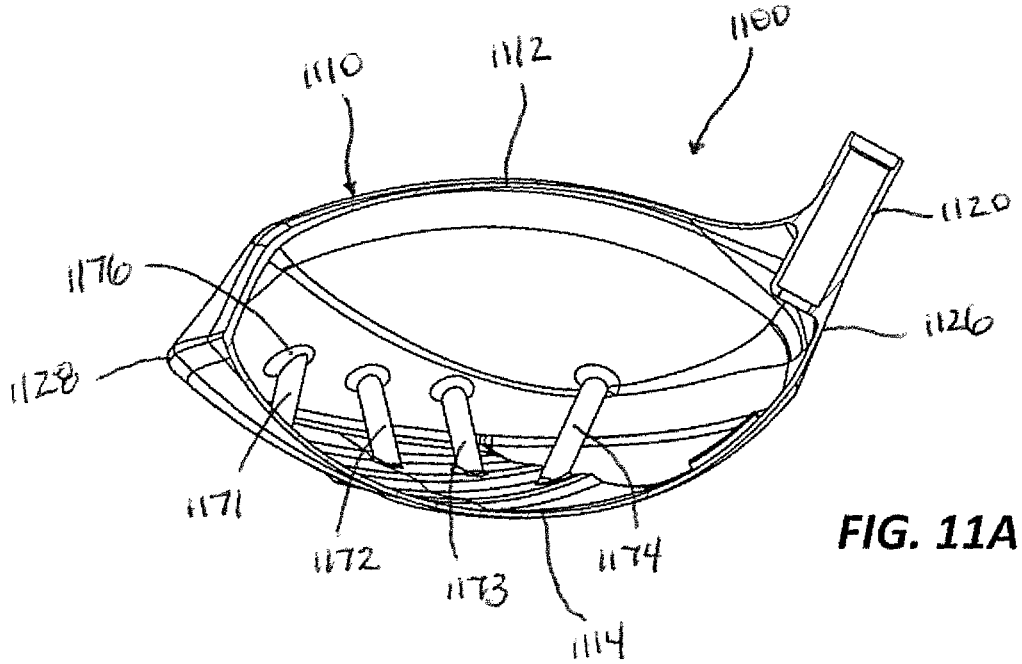
FIG. 11A is a front view of another exemplary embodiment of a golf club head with a forward portion of the club head removed for clarity.
Figure 11B:
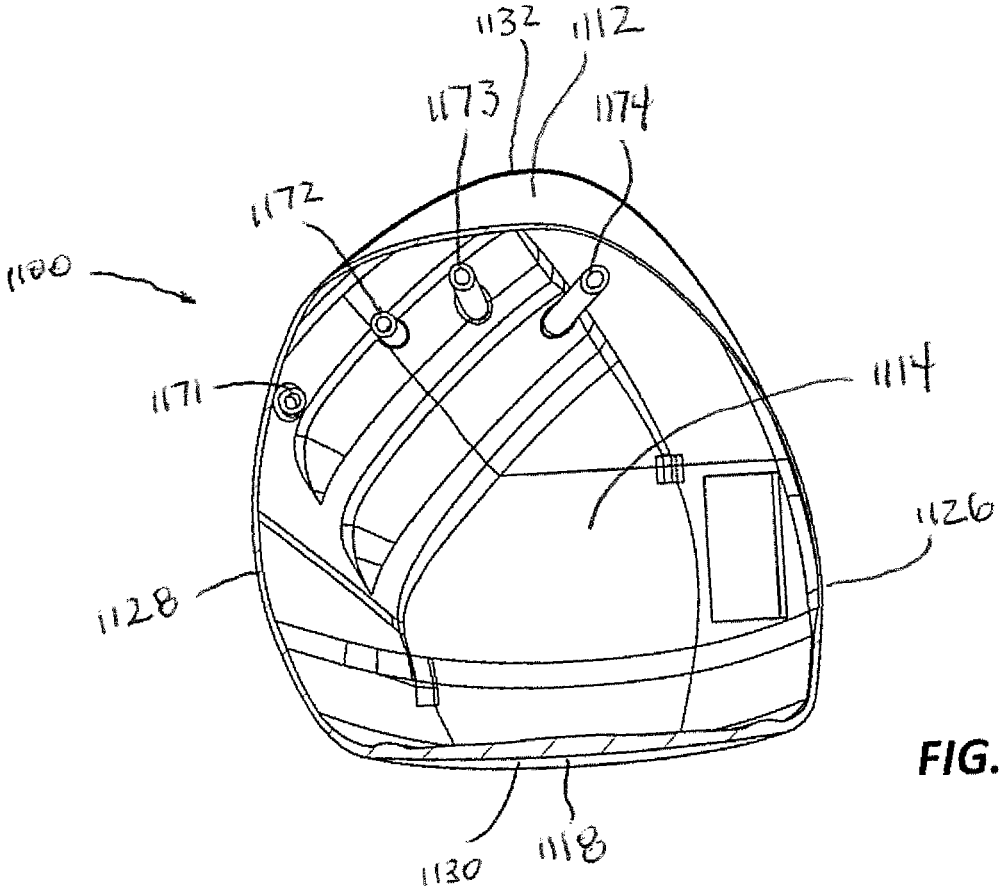
FIG. 11B is a top view of the golf club head embodiment shown in FIG. 11A with a portion of the crown removed for clarity.

Referring to FIGS. 11A-B, another embodiment of a wood-type golf club head 1100 is shown. The golf club head 1100 includes a hollow body 1110 defining a crown portion 1112, a sole portion 1114, a skirt portion 1116, and a ball striking club face 1118. The ball striking club face 1118 can be integrally formed with the body 1110 or attached to the body. The body 1110 further includes a hosel 1120, which defines a hosel bore 1124 adapted to receive a golf club shaft. The body 1110 further includes a heel portion 1126, a toe portion 1128, a front portion 1130, and a rear portion 1132.

In the embodiment shown in FIGS. 11A-B, each of a first stiffening tube 1171, a second stiffening tube 1172, a third stiffening tube 1173, and a fourth stiffening tube 1174 is attached at a first end to the sole 1114 of the golf club head and at a second end to the crown 1112 of the golf club head. The four stiffening tubes 1171, 1172, 1173, and 1174 are generally aligned near the rear portion 1132 of the golf club head extending substantially from the rear heel side 1126 to the rear toe side 1128 of the club head.

The components of the club head 1100 and the stiffening tubes 1171, 1172, 1173, and 1174 of the FIGS. 11A-B embodiment may be constructed of the same or similar materials and have generally the same or similar sizes and shapes as the corresponding components of the club head 1000 and the stiffening tubes 1071, 1072, 1073, and 1074 of the embodiment shown in FIGS. 10A-B and described above.

Figure 12A:
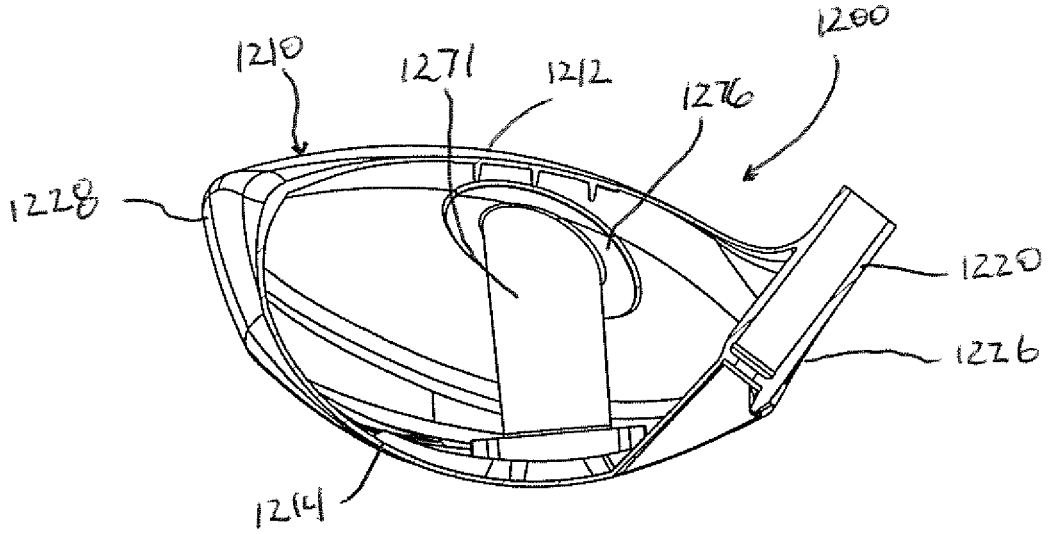
FIG. 12A is a front view of still another exemplary embodiment of a golf club head with a forward portion of the club head removed for clarity.
Figure 12B:
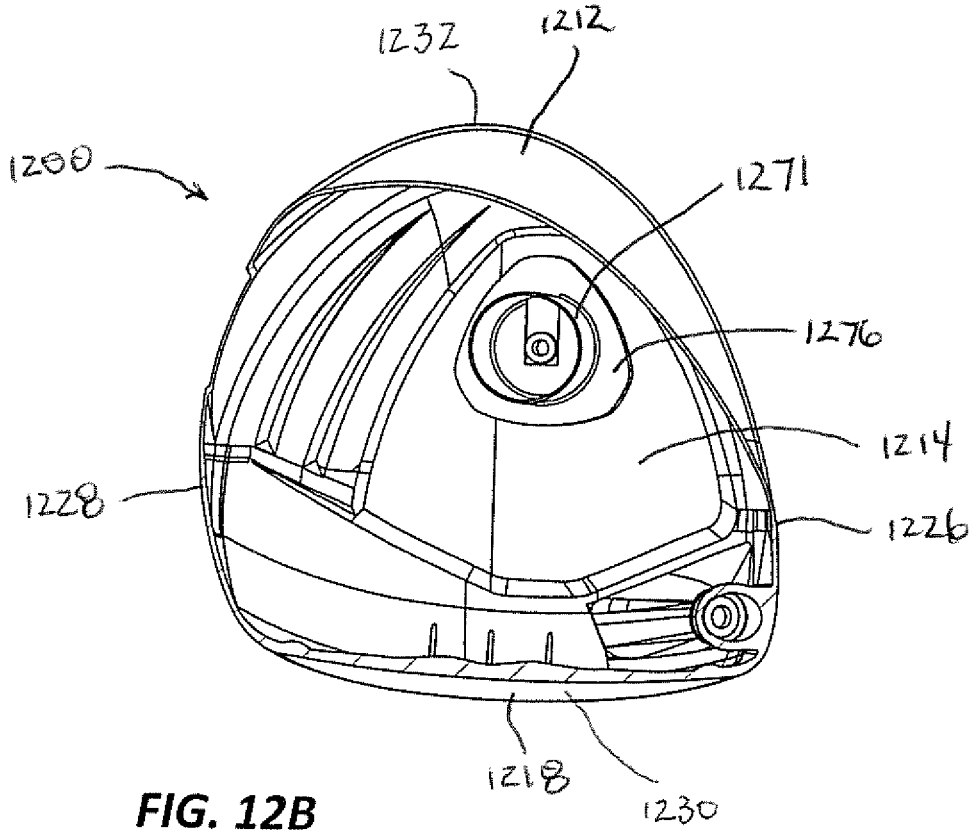
FIG. 12B is a top view of the golf club head embodiment shown in FIG. 12A with a portion of the crown removed for clarity.

Yet another embodiment of a golf club 1200 head is shown in FIGS. 12A-B, in which a single stiffening tube 1271 extends between the crown portion 1212 and sole portion 1214 of the club head. The stiffening tube 1271 is preferably formed of a polymer-fiber composite material. In the embodiment shown, the stiffening tube 1271 is attached to the sole 1214 such that a base portion of the stiffening tube 1271 surrounds a port adapted to attach an adjustable sole portion such as those described in U.S. Patent Application Publication No. 2011/0312347, which was incorporated by reference above.

In some embodiments of the golf club head 1000 shown and described above in relation to FIGS. 10A-B, the stiffening tubes 1071, 1072, 1073, and 1074 are attached to the crown 1012 and sole 1014 via a welding procedure. For example, in some embodiments in which the crown 1012 and sole 1014 are formed as separate components, the stiffening tubes 1071, 1072, 1073, and 1074 are welded to their respective locations on the sole 1014 component prior to joining the crown 1012 to the sole 1014. In some of these embodiments, the crown 1012 is provided with a hole at each location in which one of the stiffening tubes 1071, 1072, 1073, and 1074 is to be attached to the crown 1012. The hole(s) are slightly larger than the cross-sectional dimension of the end(s) of the stiffening tube(s) 1071, 1072, 1073, and 1074, such that the ends of each of the stiffening tubes 1071, 1072, 1073, and 1074 extend a short distance through the respective hole in the crown 1012 when the crown 1012 is joined to the sole 1014, such as via welding or brazing. After the crown 1012 is attached to the sole 1014 and/or other portions of the club head body 1010, the ends of each of the stiffening tubes 1071, 1072, 1073, and 1074 are welded to the crown 1012 from the exterior of the club head body 1010. After welding, the club head body 1010 is polished and otherwise finished to remove any remnants of the welding process and to render the exterior surface of the crown 1012 smooth.

In other embodiments, such as the golf club head 1100 illustrated in FIGS. 11A-B and the golf club head 1200 illustrated in FIGS. 12A-B, one or both ends of each of the stiffening tubes 1171, 1172, 1173, 1174, and/or 1271 are attached to the crown 1112, 1212 and/or the sole 1114, 1214 via one or more attachment brackets 1176, 1276. The attachment brackets 1176, 1276 may be attached to the crown 1112, 1212 and/or the sole 1114, 1214 via welding, adhesive, or other process. In some embodiments, the brackets 1176, 1276 include a slot by which a stiffening tube 1171, 1172, 1173, 1174, and/or 1271 may slide into engagement with the bracket 1176, 1276.

In some of the embodiments shown in FIGS. 10A-B, 11A-B, and 12A-B, the stiffening tubes are attached to the sole, crown, or other portion of the golf club head (or to another stiffening tube) such that the stiffening tubes are not under a compression or tension load when the golf club head is not in use. In other words, the stiffening tubes have supporting dimensions (e.g., lengths) that are the same as the corresponding dimensions of the interior of the club head body to which the stiffening tubes are attached so that those dimensions would not substantially change (when the golf club head is not in use) even if the supporting tubes were removed from the structure.

The stiffening tubes of the present disclosure are lightweight and compact. By way of example only, in specific implementations, the combined mass of the stiffening tubes of the golf club head embodiments shown and described above in relation to FIGS. 10A-B and 11A-B can be approximately 8 grams or less, such as 6 grams or less. Of course, in other implementations, the particular dimensions of the ribs may vary, and optimal dimensions and combined mass may be different for different head designs.

Preferably, the overall frequency of the golf club head, e.g., the average of the first mode frequencies of the crown, sole and skirt portions of the golf club head, generated upon impact with a golf ball is greater than 3,000 Hz. Frequencies above 3,000 Hz provide a user of the golf club with an enhanced feel and satisfactory auditory feedback. However, a golf club head having a larger volume and/or having relatively thin walls can reduce the first mode vibration frequencies to undesirable levels. The addition of the stiffening tubes described herein can significantly increase the first mode vibration frequencies, thus allowing the first mode frequencies to approach a more desirable level and improving the feel of the golf club to a user.

For example, golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc.

The golf club head design was made of titanium and shaped similar to the head shown in FIGS. 11A-B, except that several iterations were run in which the golf club head had different combinations of the stiffening tubes 1171, 1172, 1173, and 1174 present or absent. Referring to Table 2 below, the predicted first or normal mode frequency of the golf club head, i.e., the frequency at which the head will oscillate when the golf club head impacts a golf ball, was obtained using FEA software for the various golf club head designs and is shown. The club head mass for each of the designs is also listed in Table 2.

TABLE 2

| Description | First Mode | Mass |
|---|---|---|
| No stiffening tubes | 2247 Hz | 181.1 g |
| Stiffening tube 1172 only | 2801 Hz | 183.2 g |
| Stiffening tubes 1172 and 1173 | 2977 Hz | 184.2 g |
| Stiffening tubes 1171 and 1173 | 2896 Hz | 183.9 g |
| Stiffening tubes 1173 and 1174 | 2723 Hz | 184.5 g |
| Stiffening tubes 1171 and 1172 | 2816 Hz | 183.8 g |
| Stiffening tubes 1172 and 1174 | 3027 Hz | 184.4 g |
| Stiffening tubes 1171 and 1174 | 2573 Hz | 184.1 g |
| Stiffening tubes 1171, 1172, and 1173 | 3020 Hz | 184.7 g |
| Stiffening tubes 1171, 1173, and 1174 | 3315 Hz | 185.1 g |
| Stiffening tubes 1171, 1172, 1173, and 1174 | 3435 Hz | 185.9 g |

As shown in Table 2, the predicted first mode frequency of the golf club head without any stiffening tubes is well below the preferred lower limit of 3,000 Hz. By adding stiffening tubes in the manner shown, the predicted first mode frequency of the golf club head can be increased into a more desirable frequency range. Based on the results of the analysis, the impact of having stiffening tubes attached to the interior surfaces of a golf club head on the first mode frequency is quite significant.

Having illustrated and described the principles of the illustrated embodiments, it will be apparent to those skilled in the art that the embodiments can be modified in arrangement and detail without departing from such principles. In view of the many possible embodiments to which the principles of the disclosed invention(s) may be applied, it should be recognized that the illustrated embodiments are only examples of the invention(s) and should not be taken as limiting the scope of the invention(s).

The invention claimed is:

1. A golf club head comprising:

a club head body having an upper portion, a heel portion, a toe portion, a front portion, a rear portion, and a sole portion;

a face coupled to the front portion of the club head body, such that the club head defines a hollow interior region between the face, the upper portion, the sole portion, and the rear portion;

wherein at least the upper portion of the club head body comprises an exterior wall of the club head body and a lattice-like structure that includes a plurality of hexagonally-shaped thin regions that are surrounded by a web of thick regions, the thick regions being relatively thicker than the thin regions;

wherein the lattice-like structure is co-formed with the exterior wall of the upper portion of the club head body; and wherein the lattice-like structure is formed from a same material as is used to form the exterior wall of the club head body; and at least one stiffening member positioned within the hollow interior region, wherein the at least one stiffening member extends between and is co-formed with the upper portion and the sole portion, and wherein the at least one stiffening member provides structural support to the club head body and comprises: a first elongate stiffening member positioned within the hollow interior region in a rear portion of the club head body and at least partially within the toe portion of the club head body, and spaced apart from both a heel side and a toe side of the hollow interior region, wherein the first elongate stiffening member extends along a length between a first end and a second end and has a first angled orientation, wherein the second end is positioned in the upper portion of the club head and heelward of the first end, and a second stiffening member positioned within the hollow interior region having a second angled orientation that is different from the first angled orientation.

2. The golf club head of claim 1, wherein the web of thick regions comprises a hexagonal lattice that separates the thin regions.

3. The golf club head of claim 1, wherein the thin regions are aligned in a plurality of rows on the club head body.

4. The golf club head of claim 3, wherein the web of thick regions defines non-linear paths between adjacent rows of the thin regions.

5. The golf club head of claim 1, wherein each of the hexagonally-shaped thin regions is oriented with a largest dimension extending in a front-rear direction, the largest dimension being defined between two opposing vertices of the hexagonally-shaped thin region.

6. The golf club head of claim 1, wherein the upper portion comprises a forward upper portion that is forward of a hosel axis of the club head, and a rearward upper portion that is rearward of the hosel axis, and wherein the lattice-like structure is located in the rearward upper portion.

7. The golf club head of claim 1, wherein the lattice-like structure extends over substantially a full width of the upper portion from the heel portion to the toe portion.

8. The golf club head of claim 1, wherein a thickness differential between the thin regions and the thick regions is at least 0.05 mm.

9. The golf club head of claim 1, wherein a thickness differential between the thin regions and the thick regions is at least 0.1 mm.

10. The golf club head of claim 9, further comprising a weight member coupled to the club head body, the weight member having a greater density than the club head body.

11. The golf club head of claim 10, wherein the at least one stiffening member is formed on an interior side of the exterior wall.

12. The golf club head of claim 1, wherein a thickness differential between the thin regions and the thick regions is at least 0.15 mm.

13. The golf club head of claim 1, wherein the at least one stiffening member is formed on an interior side of the exterior wall.

14. The golf club head of claim 1, wherein the at least one stiffening member is positioned in a rear portion of the golf club head.

15. The golf club head of claim 1, wherein the at least one elongate stiffening member comprises a lower portion that connects to a rear portion of the hollow interior region.

16. The golf club head of claim 1, wherein the at least one elongate stiffening member comprises an upper portion positioned rearward of a hosel of the golf club head.

17. A golf club head comprising:

a club head body having an upper portion, a heel portion, a toe portion, a front portion, a rear portion, and a sole portion;

a face coupled to the front portion of the club head body, such that the club head defines a hollow interior region between the face, the upper portion, the sole portion, and the rear portion;

wherein at least the upper portion of the club head body comprises an exterior wall of the club head body and a plurality of thin regions that are surrounded by a lattice-like structure of thick regions, the thick regions being relatively thicker than the thin regions, wherein the lattice-like structure of thick regions defines a plurality of shapes within the thin regions, wherein the plurality of shapes comprises a hexagonal shape;

wherein the lattice-like structure of thick regions and the plurality of thin regions are co-formed with the exterior wall of the upper portion of the club head body; and wherein the lattice-like structure of thick regions and the plurality of thin regions are formed from a same material as is used to form the exterior wall of the club head body; and at least one stiffening member positioned within the hollow interior region, wherein the at least one stiffening member: provides structural support to the club head body, and comprises at least one elongate stiffening member extending between and co-formed with the upper portion and the sole portion, wherein the at least one elongate stiffening member: extends along a length between a first end positioned in the sole portion of the club head and a second end positioned in the upper portion of the club head, wherein the second end is positioned heelward of the first end and is spaced apart from a heel side of the hollow interior region, and is positioned in a rear portion of the club head body and at least partially within the toe portion of the club head body.

18. The golf club head of claim 17, wherein the upper portion comprises a forward upper portion that is forward of a hosel axis of the club head, and a rearward upper portion that is rearward of the hosel axis, and wherein the plurality of thin regions and lattice-like structure of thick regions are located in the rearward upper portion.

19. The golf club head of claim 17, wherein the lattice-like structure of thick regions extends over substantially a full width of the upper portion from the heel portion to the toe portion.

20. The golf club head of claim 17, wherein a thickness differential between the thin regions and the thick regions is at least 0.05 mm.

21. The golf club head of claim 20, wherein the at least one stiffening member is formed on an interior side of the exterior wall; and the golf club head further comprising a weight member coupled to the club head body, the weight member having a greater density than the club head body.

22. A golf club head comprising:

a club head body having an upper portion, a heel portion, a toe portion, a front portion, a rear portion, and a sole portion;

a face coupled to the front portion of the club head body, such that the club head defines a hollow interior region between the face, the upper portion, the sole portion, and the rear portion;

wherein at least the upper portion of the club head body comprises an exterior wall of the club head body and a lattice-like structure that includes a plurality of thin regions that are surrounded by a web of thick regions, the thick regions being relatively thicker than the thin regions;

wherein the thin regions are aligned in a plurality of rows on the club head body;

wherein the web of thick regions defines non-linear paths between adjacent rows of the thin regions;

wherein the web of thick regions and the plurality of thin regions are co-formed with the exterior wall of the upper portion of the club head body; and wherein the web of thick regions and the plurality of thin regions are formed from a same material as is used to form the exterior wall of the club head body; and at least one stiffening member positioned within the hollow interior region, wherein the at least one stiffening member extends between and is co-formed with the upper portion and the sole portion, provides structural support to the club head body, and comprises: a first elongate stiffening member positioned within the hollow interior region in a rear portion of the club head body and at least partially within the toe portion of the club head body, and that is spaced apart from both a heel side and a toe side of the hollow interior region and extending along a length between a first end and a second end, wherein the second end is positioned in the upper portion of the club head, and wherein the first elongate stiffening member has a first angled orientation in a heel-toe direction, and a second stiffening member positioned within the hollow interior region and extending along a length between a first end positioned in the sole portion of the club head and a second end positioned in the upper portion of the club head, the second stiffening member having a second orientation that is different from the first angled orientation.

23. The golf club head of claim 22, wherein the non-linear paths form a polygonal shape.

24. The golf club head of claim 22, wherein the non-linear paths form a zig-zag shape having alternating sharp turns.

25. The golf club head of claim 24, wherein the thin regions have a polygonal shape with vertices at the sharp turns.

26. The golf club head of claim 22, wherein the web of thick regions and the plurality of thin regions are formed on a first, interior side of the exterior wall of the upper portion of the club head body and a second, exterior side of the exterior wall of the upper portion of the club head body is formed as a smooth external surface.

27. The golf club head of claim 26, wherein the smooth external surface is formed by removing protruding portions of the exterior wall.

28. The golf club head of claim 22, wherein the at least one stiffening member is formed on an interior side of the exterior wall.

* * * * *